US005124244A

United States Patent [19]

Waki et al.

[11] Patent Number: 5,124,244

[45] Date of Patent: Jun. 23, 1992

[54] SILVER HALIDE COLOR PHOTOGRAPHIC MATERIAL

[75] Inventors: Koukichi Waki; Shigeharu Urabe, both of Kanagawa, Japan

[73] Assignee: Fuji Photo Film Co., Ltd., Ashigara, Japan

[21] Appl. No.: 632,620

[22] Filed: Dec. 26, 1990

Related U.S. Application Data

[63] Continuation of Ser. No. 466,624, Jan. 17, 1990, abandoned.

[30] Foreign Application Priority Data

Jan. 18, 1989 [JP] Japan ..... 1-9506

[51] Int. Cl.[5] ..... G03C 1/0005

[52] U.S. Cl. ..... 430/567; 430/569; 430/543

[58] Field of Search ..... 430/567, 569

[56] References Cited

U.S. PATENT DOCUMENTS

| | | | |
|---|---|---|---|
| 3,317,322 | 5/1967 | Porter et al. | 430/567 |
| 3,790,386 | 5/1974 | Posse et al. | 430/642 |
| 3,935,014 | 1/1976 | Klotzer et al. | 430/567 |
| 4,434,226 | 2/1984 | Wilgus et al. | 430/569 |
| 4,495,277 | 1/1985 | Becker et al. | 430/569 |
| 4,581,327 | 4/1986 | Habu et al. | 430/567 |
| 4,879,208 | 11/1989 | Urabe | 430/569 |
| 4,904,580 | 2/1990 | Komatsu et al. | 430/567 |
| 4,917,991 | 4/1990 | Toasaka et al. | 430/567 |
| 4,952,491 | 8/1990 | Nishikawa et al. | 430/567 |
| 4,977,075 | 12/1990 | Ihama et al. | 430/569 |
| 5,035,991 | 7/1991 | Ichikawa et al. | 430/569 |

*Primary Examiner*—Richard L. Schilling
*Assistant Examiner*—Thomas R. Neville
*Attorney, Agent, or Firm*—Burns, Doane, Swecker & Mathis

[57] ABSTRACT

Disclosed is a silver halide color photographic material comprising at least one silver halide emulsion layer on a support. The silver halide emulsion contains silver chlorobromide grains having a 2 to 4 layer stacked structure which layers differ in their content of silver chloride. The silver chloride distribution of each layer of the grains is completely uniform, and the difference in the silver chloride content between a first layer and a second layer of said grains ranges from 5 mole % to 27 mol %.

15 Claims, 2 Drawing Sheets

SILVER HALIDE COLOR PHOTOGRAPHIC MATERIAL

This application is a continuation of application Ser. No. 07/466,624 filed Jan. 17, 1990, now abandoned.

FIELD OF THE INVENTION

The present invention relates to silver halide color photographic material. In particular, the present invention relates to silver halide color photographic materials containing silver halide grains which are contrasty and have excellent pressure resistance and latent image preservation.

BACKGROUND OF THE INVENTION

Silver halide photosensitive emulsions containing silver chloride are well known and offer many advantages. For example, they are more soluble than other photographically effective silver halides, so that shorter development and fixing times can be achieved.

In recent years, color photographic materials have become widely used and, in addition, development processing has come to be performed more and more simply and rapidly. On the other hand, high image quality and uniformity of finishing quality have been demanded.

In simplification and speeding up, specifically, reduction of the number of processing baths, reduction of the amount of replenishment (low replenishing), and shortening of processing times have come to be highly desirable in this industry. While silver chlorobromide emulsions have been found to be very advantageous in terms of rapid processing, their speeds are low, effective chemical and spectral sensitizations are difficult to obtain and the speeds which are obtained are generally unstable. These emulsions possess the further disadvantage of being easily fogged.

Several methods have been proposed to remedy the aforementioned disadvantages. There are known techniques such as those disclosed in JP-A-48-51627 (the term "JP-A" as used herein refers to a "published unexamined Japanese patent application") and JP-B-49-46932 (the term "JP-B" as used herein refers to an "examined Japanese patent publication") wherein water-soluble bromide ions or iodide ions are added after the addition of a photosensitizing dye to a silver halide emulsion. The method disclosed in JP-A-58-108533 and JP-A-60-222845 involves disposing on the grain surface a layer having 60 mol% or more of silver bromide, by adding bromide ions and silver ions simultaneously to silver halide grains having a high percentage content of silver chloride. Furthermore, there is a method of disposing wholly or partially a layer of 10 mol% to 50 mol% of silver bromide on the surface of these grains. JP-B-50-36978, JP-B-58-24772, U.S. Pat. No. 4,471,050 and West German Patent (OLS) 3,229,999 describe methods wherein polyphase structure grains such as core and shell, 2-fold structure grains or a composite structure grains are obtained by adding bromide ions, or simultaneously adding bromide ions and silver ions, to a silver halide having a high content of silver chloride, and by halogen conversion. The aforementioned patent documents describe techniques wherein local changes in the amount of silver bromide contained in individual silver chlorobromide grains (i.e., the inside or outside of the grains, or disposition on the grain surface) are provided, and by these means improved photographic properties are obtained.

Nevertheless, silver chlorobromide emulsions of sufficiently satisfactory gradation, pressure resistance and latent image preservation have not yet been obtained by these prior art methods.

SUMMARY OF THE INVENTION

An object of the present invention is to provide contrasty silver halide color photographic materials having excellent pressure resistance and latent image preservation.

This object can be accomplished by a silver halide color photographic material possessing at least one silver halide emulsion layer on a support, wherein the silver halide grains in the silver halide emulsion are silver chlorobromide possessing a stacked structure of two to four layers, each layer differing in their content of silver chloride, and the silver chloride distribution of each layer is completely uniform, the difference in the silver chloride content between a first layer and a second layer being at least 5 mol% and at most 27 mol%.

DETAILED DESCRIPTION OF THE INVENTION

The silver chlorobromide grains used in the present invention which possess a silver chlorobromide phase having a completely uniform silver chloride distribution are explained below. Here, the term "completely uniform silver chloride distribution" means a microscopic distribution, and entirely different from what has been dealt with up to now.

As means to measure the silver chloride distribution (or silver bromide distribution) in the silver chlorobromide grains, analytical electron microscopy may be used. However, it is impossible to reveal more microscopic changes (local changes of 300 Å and below) by this measurement method. This microscopic distribution of silver chloride can be observed by means of a direct method using a transmission type electron microscope at low temperature, as disclosed, for example, in J. F. Hamilton, *Photographic Science and Engineering*, Vol. 11, 1967, p. 57, and Takeo Shiozawa, *Japanese Photographic Society*, Vol. 35, No. 4 (1972), p. 213. Namely, without printing out the emulsion grains, extracting the silver halide grains under a safelight and placing them on the electron microscope observation mesh, observation is performed by a transmission method, avoiding damage (print-out, etc.) due to the electron beam, with the sample cooled by liquid nitrogen or liquid helium.

By using a higher accelerating voltage of the electron microscope, a more distinct transmission image can be obtained. For grain thicknesses of up to 0.25 μm, 200 kv may be used, and for larger grain thickness, 1,000 kv can be used. When higher accelerating voltages are used, there is greater damage to the grains due to the electron beam. Therefore, using liquid helium is more desirable than liquid nitrogen for cooling the specimen.

The photographic magnification is suitably altered according to the size of the specimen grains, and is preferably 20,000 to 40,000 times.

In this way, transmission electron microscope photographs of the tabular silver chlorobromide grains known in the prior art are taken and a very minute striation pattern, similar to annual rings, is observed in a portion of the silver chlorobromide phase. An example of this is shown in FIG. 1.

Figure 1:
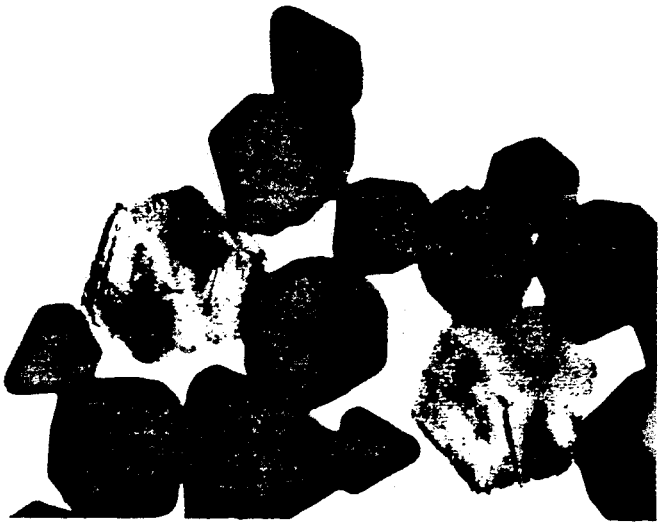
FIG. 1 is a transmission electron micrograph showing the crystal structure of a prior art silver halide grain in which the distribution of silver chloride in the silver chlorobromide is not completely uniform; the magnification is ×15,000.

As shown in FIG. 1, the silver chlorobromide tabular grains shown here have a silver chloride content of 35% and a very minute striation pattern similar to annual rings can be clearly discerned. The interval of this striation pattern is very fine, along the order of 100 Å or less, and is understood to demonstrate a microscopic nonuniformity. This minute striation pattern which demonstrates a nonuniformity of the silver chloride distribution can be confirmed by various methods. It can be determined from the complete disappearance of this striation pattern when the chloride ions in the silver halide crystals are given the ability to migrate upon annealing (for example, 250° C., 3 hours) of the tabular grains.

No cases of observations of annual ring-like fine striation have up to now been mentioned as showing the microscopic nonuniform silver chloride distribution in tabular silver halide grains containing silver chloride such as tabular silver chlorobromide grains. This was first discovered by the present inventors. Up to now, the silver chlorobromide grains which were prepared so as to obtain a uniform silver chloride distribution actually contained microscopic nonuniformity of the silver chloride distribution. Techniques to make these uniform have not been disclosed, nor has a method for manufacturing grains with a uniform silver chloride distribution.

The tabular silver halide grains having a "completely uniform silver chloride distribution" according to the present invention can be distinguished from the prior art silver halide grains by observing the transmission images of the grains, using a cooled transmission electron microscope. In the silver halide grains of the present invention containing silver chloride, there are not more than 2, preferably not more than 1, and more preferably zero, in an interval of 0.2 μm, of the microscopic lines attributable to microscopic nonuniformity of silver chloride. The lines forming this annual ring pattern of fine striations which show the microscopic nonuniformity of silver chloride, develop in a form crossing the direction of grain growth. The lines are distributed in concentric circles around the centers of the grains. In the case of the tabular grains shown in FIG. 1 which shows nonuniformity of silver chloride, the lines formed by the annual ring-like fine striations cross the growth direction of the tabular grains. The crossing direction is in the direction of the grain centers and the lines of the annual ring-like fine striations are distributed concentrically surrounding the centers of the grains.

If the silver chloride content should be changed abruptly during grain growth, this boundary like would be observed as a line similar to those mentioned above in the above-mentioned observation method. But this type of change of silver chloride content would only form a single line, and can be distinguished from the plurality of lines derived from nonuniformity of silver chloride. Furthermore, lines due to changes in silver chloride content could clearly be detected if the silver chloride content on each side of these lines were to be measured by the initially mentioned method of analytical electron microscopy. Lines due to this type of change in silver chloride content are completely different from the lines derived from the microscopic nonuniformities of silver chloride. In the present invention, they are referred to as those displaying a "macroscopic silver chloride distribution". In the case where the amount of silver chloride is continuously changed during the growth of the grains, and there are no abrupt changes in the silver chloride content, the above-mentioned lines displaying a macroscopic silver halide content change are not observed. Accordingly, if 3 or more lines are present in an interval of 0.2 μm, there are microscopic nonuniformities in the silver chloride content.

In the stacked silver halide grains of the present invention having a silver chloride distribution of each layer being completely uniform, there are, apart from the boundaries of the layers, 2 or fewer, preferably 1 or fewer, more preferably 0, lines displaying microscopic silver chloride distribution in a 0.2 μm interval in the direction crossing the grain growth, in the transmission images of the obtained grains, using a cooled transmission electron microscope. Also, grains of this type are silver halide grains making up at least 40%, preferably at least 60%, more preferably at least 80%, of all the grains.

The number of layers in the stacked silver halide grains used according to the present invention ranges from 2 to 4, preferably 2 to 3. If there are more than 4 layers, the properties of silver halide grains possessing a completely uniform silver chloride distribution will be damaged. Further, if there is only one layer, it has the drawback of poor latent image preservation.

According to the present invention, the difference in silver chloride content between a first layer and a second layer ranges from 5 mol% to 27 mol%. If the difference is less than 5 mol%, speed will be reduced, and fog will easily form due to pressure. When the difference is greater than 27 mol%, the grain shapes become disordered, and in addition, desensitization will be easily caused by pressure. A more preferred difference in silver chloride content ranges from 8 mol% to 25 mol%, preferably 10 mol% to 23 mol%. The silver chloride contents may be greater in the first layer than in the second layer, or vice versa.

According to the present invention, the overall composition of the stacked silver halide grains having a completely uniform silver halide distribution in each layer comprises 10 mol% to 95 mol%, preferably 20 mol% to 95 mol% of silver chloride. Silver iodide may also be present, but preferably in amounts less than 1 mol%, more preferably none is present. A layer containing silver iodide may be in any position.

There is preferably a narrow size distribution of the silver halide grains used in the present invention. In the case where the projected area is approximately represented by the diameter of a circle, the statistical coefficient of variation (=standard deviation S/mean grain size d) is not more than 0.20, preferably not more than 0.15.

The silver halide grains according to the present invention may possess a cubic, octahedral, dodecahedral, 14-faced, 24-faced (3,8-faced, 4,6-faced, oblate rhomboid 24-faced), 46-faced and the like regular crystal form (normal crystal grains). They may be spherical, or of potato-shaped or the like irregular crystal form. They may be grains of various forms having 1 or more twinned crystals such as hexagonal tabular grains with 2 or 3 parallel twinned crystal faces, and trigonal tabular grains.

Methods for producing silver halide grains used according to the present invention will be described below. Generally, these methods include nucleus formation and grain growth.

Nucleus Formation

The nuclei of the silver halide grains of the present invention can be prepared using methods such as those disclosed in *Chemie et Physique Photographique* by P. Glafkides (Paul Montel, 1967), *Photographic Emulsion Chemistry* by G. F. Duffin (The Focal Press, 1966), *Making and Coating Photographic Emulsion* by V. L. Zelikman et al (The Focal Press, 1964), etc. That is, any of acid methods, neutral methods, and ammonia methods may be used. Furthermore, a single jet mixing method, a double jet mixing method, or a combination of these may be used for causing the soluble silver salt and the soluble halide salt to react.

The method in which grains are formed in the presence of an excess of silver ions (i.e., reverse mixing) can be used. As one system for a simultaneous mixing method, there is the controlled double jet method wherein the pAg of the liquid phase for silver halide formation is kept constant. In this method, a silver halide emulsion can be obtained with grains of regular crystal form and close to uniform size.

Two or more silver halide emulsions which have been separately formed may be mixed and used.

When preparing the nuclei of the silver halide grains, a fixed halide composition is preferable, using the double jet method or the controlled double jet method.

The pAg when preparing the nuclei changes with reaction temperature and with various types of solvents for silver halide, but is preferably in the range of 5 to 10. It is preferred to use the solvents for silver halide, because grains can be formed in a short time. Ammonia, thioethers and the like generally well known solvents for silver halide can be used.

The form of the nuclei can be tabular, spherical, or twinned. Octahedral, cubic, 14-faced or mixed types can be used.

The nuclei may be polydisperse or monodisperse, however, monodisperse nuclei are more preferable. Here, "monodisperse" has the same meaning as mentioned above.

In order to obtain uniform grain size, there are preferably used methods wherein the addition rate of silver nitrate or aqueous solutions of alkali metal halides is changed according to the growth rate of grains as disclosed in British Patent 1,535,016, JP-B-48-36890 and JP-B-52-16364, and methods wherein the concentrations of aqueous solutions are varied to rapidly grow the grains in a range which does not exceed the critical degree of supersaturation as described in U.S. Pat. No. 4,242,445 and JP-A-55-158124. These methods can be preferably used where coating layers described hereinafter are introduced, because each silver halide grain is uniformly coated without causing renucleation.

In the above-described methods for nucleus formation, an aqueous solution of a silver salt and an aqueous solution of a halogen salt are added to a reaction vessel containing an aqueous solution of a dispersant while vigorously stirring the dispersion. However, nucleus formation can also be made without adding the aqueous solution of silver salt and the aqueous solution of halogen salt. That is, the nucleus formation can be made by adding fine grains of silver halide, or by adding the grains and successively ripening the grains as mentioned below with regard to growth. The size of fine silver halide grains to be added is preferably not larger than 0.1 μm, more preferably not larger than 0.06 μm, still more preferably not larger than 0.03 μm. Methods for preparing fine grains of silver halide will be illustrated in more detail in the item of growth. The fine silver halide grains have a high solubility because of their minute size. When the fine grains are added to the reaction vessel, they are dissolved to form silver ions and halogen ions again. They are deposited on very small part of fine grains introduced into the reaction vessel to form nuclear grains. In the methods for nucleus formation, solvents for silver halide may be optionally used and will be illustrated hereinafter. The nucleation temperature is preferably not lower than 50° C., more preferably not lower than 60° C. The fine silver halide grains may be added once or continuously. When the grains are continuously added, they may be added at a fixed flow rate, or the flow rate may be increased with time.

A cadmium salt, a zinc salt, a lead salt, a thallium salt, an iridium salt or a complex thereof, a rhodium salt or a complex thereof, an iron salt or a complex thereof may be present during the formation of silver halide grains or the physical ripening thereof.

Growth

After the completion of the nucleus formation, in order to grow the previously formed nuclei, an aqueous solution of an alkali metal halide and a water-soluble silver salt are freshly added to the reaction vessel so as not to cause fresh formation of new nuclei. In conventional methods, an aqueous solution of a halogen salt and a silver salt are added to the reaction vessel with efficiently stirring. When a silver halide having a single halogen composition (e.g., silver bromide, silver chloride) is grown, silver halide phase is perfectly uniform and microscopic nonuniformity is not observed even when observed using a transmission type electron microscope. When a silver halide has a single halide composition, it is impossible in principle that nonuniform growth (exclusive of dislocation) is caused. In the growth of pure silver bromide and pure silver chloride, nonuniformity as so termed according to the present invention is not seen irrespective of preparation conditions. However, growth with nonuniformity in the halide composition becomes a serious problem in the growth of silver halides having a plurality of halide compositions (mixed crystal). The nonuniform distribution of silver iodide can be clearly observed by means of a transmission type electron microscope as described above.

Attempts have been made to obtain uniform growth of silver halides. It is known that the growth rate of silver halide grains is greatly affected by the concentrations of silver ion and halogen salt and equilibrium solubility. Accordingly, it is considered that when concentrations (silver ion concentration and halide ion concentration) are nonuniform, a difference in growth rate between different concentrations is caused. Methods described in U.S. Pat. No. 3,415,650, British Patent 1,323,464 and U.S. Pat. No. 3,692,283 are known as methods for improving local deviations of concentration. In these methods, a reaction vessel filled with an aqueous colloidal solution is provided with a mixing device (the inside thereof being filled with an aqueous colloidal solution and preferably the mixing device being partitioned into two chambers of an upper chamber and a lower chamber with a disc), which has a rather thick cylindrical wall provided with slits and is rotated so as to allow its revolving shaft to be arranged vertically. An aqueous solution of a halogen salt and an aqueous solution of a silver salt are fed to the mixing device which rotates at high speeds from the upper and lower open ends thereof through feed pipes and are quickly mixed with each other to carry out a reaction. When there is provided the disc for partitioning the mixing device into the upper and lower chambers, an aqueous solution of a halogen salt and an aqueous solution of a silver salt fed to the upper and lower chambers are diluted with an aqueous colloidal solution with which each chamber is filled, and they are quickly mixed in the vicinity of the outlet slits of the mixing device to thereby react them. The resulting silver halide grains are discharged into the aqueous colloidal solution in the reaction vessel by the centrifugal force generated by the rotation of the mixing device to thereby grow grains. However, the problem with regard to the nonuniformity of the silver chloride distribution cannot be solved by these methods. An annual ring-like striation pattern, indicative of a nonuniform silver chloride distribution, is clearly observed by a cooled transmission type electron microscope.

JP-B-55-10545 discloses a method for improving local deviation of concentration to thereby prevent nonuniform growth from being caused. In this method, a reaction vessel filled with an aqueous colloidal solution is provided with a mixing device filled with an aqueous colloidal solution inside the vessel, an aqueous solution of a halogen salt and an aqueous solution of a silver salt are separately fed to the mixing device from the lower ends through feed pipes, both solutions are mixed with rapid stirring by means of a lower agitating blade (turbine impeller) fixed to the mixing device of the reaction vessel to grow silver halide grains, and the grown silver halide grains are immediately discharged from the upper opening of the mixing device into the aqueous colloidal solution in the reaction vessel by means of an upper agitating blade provided upward of the above-mentioned agitating blade. However, the problem with regard to nonuniformity in the silver chloride distribution cannot be solved by this method. An annual ring-like striation pattern which shows the nonuniformity of silver chloride can be clearly observed.

Thus, it was impossible to obtain a completely uniform silver chloride distribution by means of the above-disclosed methods. The inventors have eagerly studied and found that completely uniform silver chloride distribution can be obtained by a method wherein in the growth of silver halide grains containing chlorides, silver ions and halide ions (chlorine ions, bromine ions, and iodine ions) which form grains are not fed to the reaction vessel in the form of an aqueous solution but are fed in the form of fine grains of silver halide having a desired halide composition, to thereby grow grains whereby an annual ring-like striation pattern completely disappears. This cannot be achieved by conventional methods, and is a surprising finding. More concretely, the method includes: (1) A method comprising adding a previously prepared fine grain emulsion containing silver chloride to the reaction vessel; and (2) A method comprising adding a fine grain emulsion to the reaction vessel while preparing the emulsion.

First, conventional methods for preparing emulsions are illustrated below.

U.S. Pat. Nos. 3,317,322 and 3,206,313 disclose methods wherein a silver halide grain emulsion which has a mean grain size of at least 0.8 μm is chemically sensitized and forms a core, is mixed with a silver halide grain emulsion which has a mean grain size of not larger than 0.4 μm and is not chemically sensitized, and a shell is formed by ripening the mixture to prepare a silver halide emulsion having high internal sensitivity. These patents relate to a silver bromide and a silver iodobromide having a low silver iodide content and are different from the present invention which relates to grains containing silver chloride. JP-A-58-111936 discloses that instead of introducing silver and halide salts in the form of an aqueous solution the silver and halide salts can be introduced in the form of fine silver halide grains suspended in a dispersion medium at the early stage of growth or during the course of growth. A grain size is such that Ostwald ripening is easily made on grain nuclei having a size larger than grain size which may be present when introduced into the reaction vessel. Silver bromide, silver chloride and/or mixed silver halide grains can be introduced. However, these disclosures are general descriptions relating to the growth of silver halide and suggest neither a specific method for preparing the completely uniform silver halide grains of the present invention nor the specific examples thereof.

Now, each method of (1) and (2) will be illustrated in detail below.

Method (1)

In this method, grains for nuclei or cores are provided initially in the reaction vessel. Thereafter, a previously prepared emulsion containing fine grains is added thereto, and the fine grains are dissolved by Ostwald ripening and deposited on the nuclei or the cores to thereby grow grains. The halide composition of the fine grain emulsion contains the same silver chloride content as that of the desired grains. The halide composition is silver chlorobromide or silver chloroiodobromide. Grains having an average diameter of not larger than 0.1 μm are preferable, more preferably not larger than 0.06 μm. According to the present invention, the solution velocity of these fine grains is important. Preferably, solvents for silver halide are used to increase the velocity. Examples of the solvents for silver halide include water-soluble bromides, water-soluble chlorides, thiocyanates, ammonia, thioethers and thioureas.

More specifically, examples of the solvents include thiocyanates (as described in U.S. Pat. Nos. 2,222,264, 2,448,534 and 3,320,069); ammonia; thioether compounds (as described in U.S. Pat. Nos. 3,271,157, 3,574,628, 3,704,130, 4,297,439 and 4,276,347); thione compounds (as described in JP-A-53-144319, JP-A-53-82408 and JP-A-55-77737); amine compounds (as described in JP-A-54-100717); thiourea derivatives (as described in JP-A-55-2982); imidazoles (as described in JP-A-54-100717); and substituted mercaptotetrazoles (as described in JP-A-57-202531).

The temperature at which silver halide grains are grown is not lower than 50° C., preferably not lower than 60° C., more preferably not lower than 70° C. In the growth of crystals, the fine grain emulsion may be added once or portionwise. Preferably, the emulsion is fed at a fixed flow rate. More preferably, the addition rate is increased. The proper rate of the addition can be determined based on the concentration of coexisting colloid, the solubility of silver halide crystals, the size of the fine silver halide grains, the agitation degree of the reaction vessel, the size and concentration of crystals existing at each point in time, the hydrogen ion concentration (pH) and the silver ion concentration (pAg) of aqueous solution in the reaction vessel, etc., and the relationship between the desired size of crystal grains and the distribution thereof. However, such the proper rate of the addition can be simply determined by usual experimental methods.

Method (2)

In the method for growing crystals according to the present invention, fine silver halide crystals are added and Ostwald ripening is caused by utilizing the high solubility thereof to thereby grow silver halide grains, instead of feeding silver ions and halide ions (including chlorine ions) required for the growth of silver halide crystals in the form of aqueous solutions as in conventional methods. The rate-determining step is not the growth rate of silver halide grains, but how to rapidly dissolve fine grains to feed silver ions and halide ions to the reaction vessel. When fine grain emulsion is previously prepared as in the method (1), grains having a size of as small as possible are desired. On the other hand, the solubility of silver halide grains increases with a decrease in their size, and the grains become very unstable. As a result, Ostwald ripening may take place on the grains, whereby an increase in grain size is caused.

In *The Theory of the Photographic Process*, the fourth edition, written by T. H. James, Lippmann Emulsions are indicated to be fine grains having an average size of not larger than 0.05 μm. It is possible to obtain fine grains having a grain size of not larger than 0.05 μm. However, even when such fine grains can be obtained, the grains are unstable and the grain size thereof is easily increased by Ostwald ripening. When adsorbents are allowed to be adsorbed by grains, Ostwald ripening can be prevented to some extent. However, the solution rate of the grains is decreased to some extent, and the result is contrary to the object of the present invention.

This problem has been solved by the following three methods in the present invention.

(i) Immediately after fine grains are formed in the mixing device, they are added to the reaction vessel.

There is described in the above-mentioned method (1) that fine grains are previously formed to obtain a fine grain emulsion and the fine grain emulsion is redissolved and added to the reaction vessel retaining silver halide grains which become nuclei and a solvent for silver halide to thereby cause the growth of grains. However, very fine grains once formed cause Ostwald ripening during the courses of grain formation, rinsing, dispersion and redissolution and, as a result, the grain size is increased. In the present method, the mixing device is provided closely near the reaction vessel, and the residence time of added solution in the mixing device is shortened. Immediately after the formation of fine grains, the grains obtained are added to the reaction vessel so that Ostwald ripening cannot occur. Concretely, the residence time "t" of the solutions added to the mixing device is given below.

$$t = \frac{V}{a + b + c}$$

wherein "V" is the volume (ml) of the chamber of the mixing device, "a" is the amount (ml/min) of silver nitrate solution added, "b" is the amount (ml/min) of halide salt solution added, and "c" is the amount (ml/min) of protective colloidal solution added.

In the method of the present invention, "t" is not longer than 10 minutes, preferably not longer than 5 minutes, more preferably not longer than 1 minute, still more preferably not longer than 20 seconds. Thus, the fine grains obtained in the mixing device are immediately added to the reaction vessel without causing an increase in grain size.

(ii) A second method involves using a mixing device in which stirring is carried out strongly and with good efficiency.

Figure 2:
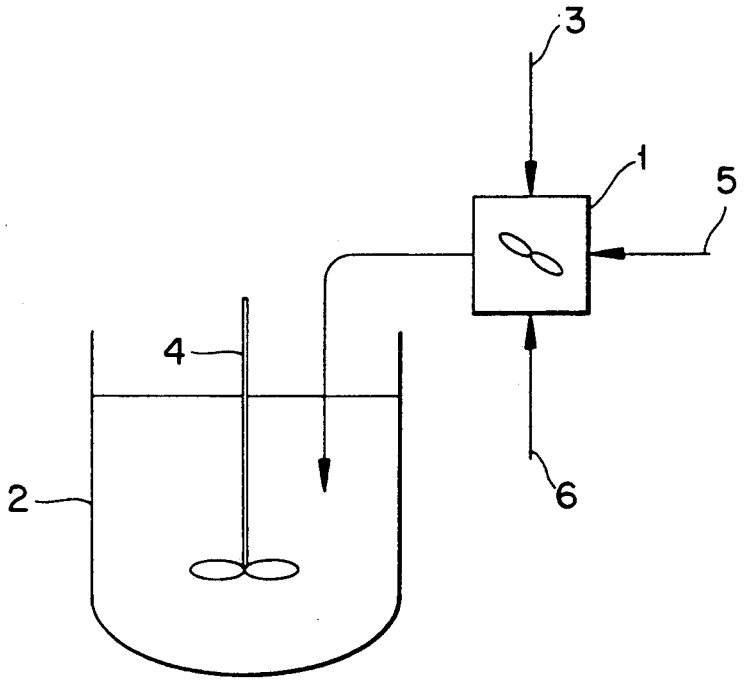
FIG. 2 indicates a typical method of providing silver halide grains from the mixing device to the reaction vessel, in one embodiment of emulsion preparation method according to the present invention. (1) is a mixing device, (2) is a reaction vessel, (3) is a silver halide aqueous solution, (4) is an agitator, (5) is an aqueous solution of protective colloid, and (6) is an aqueous solution of halide.

In *The theory of the Photographic Process*, page 93, written by T. H. James, there is described that another one form in addition to Ostwald ripening is coalescence; in coalescence ripening, crystals which are far apart from one another are directly brought into contact with one another and fuse together, and larger crystals are formed so that grain size is suddenly changed. Both Ostwald ripening and coalescence ripening are caused not only after the completion of deposition, but also during deposition. Coalescence ripening stated herein is liable to be caused particularly when grain size is very small, more particularly when stirring is insufficient. In the extreme case, there is a possibility that coarse bulky grains are formed. In the present invention, a sealed-type mixing device is used as shown in FIG. 2. Hence, the agitating blade in the reaction chamber can be rotated at a high rotational speed, and powerful efficient stirring and mixing can be made, though such powerful efficient stirring and mixing cannot be made by conventional open-type vessels (when the agitating blade is rotated at a high rotational speed in the open-type vessel, solutions are sprinkled by centrifugal force, a problem of foaming is caused and such operation cannot be put to practical use). Accordingly, the above-mentioned coalescence ripening can be prevented from being caused in the method of the present invention. As a result, fine grains having a very small grain size can be obtained. In this embodiment of the present invention, the rotational speed of the agitating blade is at least 1,000 rpm, preferably at least 2,000 rpm, more preferably at least 3,000 rpm. (iii) In a third technique, an aqueous protective colloidal solution can be introduced into the mixing device. By means of such a protective colloid for the fine silver halide grains, the above-mentioned coalescence ripening can be prevented. This addition can be done by (a) introducing the aqueous protective colloidal solution singly into the mixing device. The concentration of the protective colloid should be 1 wt% or more, preferably 2 wt% or more, and the flow rate should be at least 20% of the total flow rate of silver nitrate solution and halide solution, preferably 50% or more, and more preferably 100% or more.

Also, the addition can be made such that (b) the halide salt solution is made to contain the protective colloid. The concentration of protective colloid should be 1 wt% or more, preferably 2 wt% or more.

Furthermore, (c) the addition of the colloid can be made to the silver nitrate solution. The concentration of the protective colloid should be 1 wt% or more, preferably 2 wt% or more. In the case where gelatin is used as the protective colloid, silver ions and gelatin will produce gelatin silver which forms silver colloid on photolysis and thermal decomposition. Therefore, it is better to mix the silver nitrate solution with the protective colloidal solution directly before utilization.

The above-mentioned methods (a) to (c) may be used singly or in combination. Or the three methods may be used at the same time. Normal gelatin can be used, but other hydrophilic colloids can also be used, as well (cf. *Research Disclosure*, No. 17643 (December, 1978), Section IX).

The grain sizes of the fine grains can be confirmed by placing the grains on a mesh and using a transmission electron microscope, the magnification being 20,000 to 40,000. The size of the fine grains of the present invention should be 0.06 μm or less, preferably 0.03 μm or less, and more preferably 0.01 μm or less.

Thus, it becomes possible to supply grains of extremely fine size to the reaction vessel. Accordingly, a higher solution rate of very fine grains and a higher growth rate of the silver halide grains in the reaction vessel can be obtained. By this method the utilization of silver halide solvents is not essential. However, silver halide solvents may be utilized for obtaining higher growth rate or other objects, as required. The silver halide solvents which can be used include those mentioned with regard to Method (1). The rate of supply of silver ions and halide ions into the reaction vessel can be freely controlled. The supply rate may even be fixed, but preferably, the rate is increased. See JP-B-48-86890 and JP-B-52-16364. Other factors have been already described in Method (1). Furthermore, the halogen composition can be freely controlled during growth, e.g., during grain growth, while continuously maintaining a fixed silver chloride content, or while increasing or reducing the silver chloride content. It is possible to change the silver chloride content at some point in time.

The temperature of the reaction in the mixing device is not more than 60° C., preferably 50° C. or below, more preferably 40° C. or below. At a reaction temperature of 35° C. or below, low molecular weight gelatin (average molecular weight 30,000 or below) is preferably utilized because normal gelatin easily coagulates at that temperature.

The low molecular weight gelatin can be usually prepared as follows. Normally used gelatin of average molecular weight 100,000 is dissolved in water, a gelatin decomposing enzyme is added, and the gelatin molecule is enzymatically broken down. Regarding this method, the disclosures of R. J. Cox, *Photographic Gelatin II*, Academic Press, London, 1976, pp. 233-251, pp. 335-346 can be referred to. Since the bond position at which gelatin is cleaved by the enzyme is fixed, low molecular weight gelatin with a relatively narrow molecular weight distribution can be obtained. With a longer enzymatic decomposition time, the molecular weights will be lower. Apart from this method, there are also methods of hydrolyzing gelatin by heating in a low pH (pH 1 to 3) or high pH (pH 10 to 12) atmosphere.

Silver chlorobromide grains possessing a stacked structure with completely uniform silver chloride distribution in each layer can be manufactured by changing the silver chloride content, and carrying out the above method continuously over the desired time interval in plural times.

Suitable photographic materials used in the emulsions of the present invention are described below.

Various polyvalent metal ion impurities can be introduced during the processes of emulsion grain formation or physical ripening of the silver halide emulsions used in the present invention. As examples of the compounds utilized for this function, there are cadmium, zinc, lead, copper, thallium and the like salts, or the Group VIII elements iron, ruthenium, rhodium, palladium, osmium, iridium, platinum and the like salts or complexes. In particular, Group VIII elements are preferably used. The added amounts of these compounds can range widely, but in relation to the silver halide they are preferably $10^9$ to $10^{-2}$ mol.

The usual chemical sensitization and spectral sensitization can be used to treat the silver halide emulsions. With regard to chemical sensitization methods, sulfur sensitization representing the addition of unstable sulfur compounds, noble metal sensitization representing gold sensitization, or reduction sensitization, and the like can be used alone or in combination. As the compounds used in chemical sensitization, those disclosed in JP-A-62-215272, page 18, right-hand column, to page 22, right-hand column, are preferably used.

Spectral sensitization is carried out on the photographic materials of the present invention to provide the emulsion of each layer with spectral sensitivity in the desired light wavelength region. Spectral sensitization is preferably carried out by adding spectral sensitizing dyes which absorb light of the wavelength region corresponding to desired spectral sensitivity in the present invention. Examples of suitable spectral sensitizing dyes include those disclosed in F. M. Harmer et al., *Heterocyclic Compounds— Cyanine Dyes and Related Compounds* (John Wiley & Sons, New York, London, 1964), and those disclosed in the above-mentioned JP-A-62-215272, page 22, right-hand column to page 38.

In preparing the silver halide emulsions of the present invention, various compounds or their precursors can be added to prevent fogging during storage or during photographic processing, or with the object of stabilizing the photographic properties. These compounds are generally termed photographic stabilizers. Specific examples of these compounds can be found in the above JP-A-62-215272, pages 39 to 72.

The emulsions used in the present invention may be surface latent image-type emulsions, in which the latent image is principally formed in the grain surface. They may also be interior latent image type emulsions, in which the latent image is principally formed in the interior of the grain.

Yellow couplers, magenta couplers and cyan couplers which form yellow, magenta and cyan colorations on coupling with the oxidized form of an aromatic amine developing agent, are normally used in the color photographic materials of the present invention. Certain preferred cyan couplers, magenta couplers and yellow couplers are represented by the general formulae (I), (II), (III), (IV) and (V) set forth below.

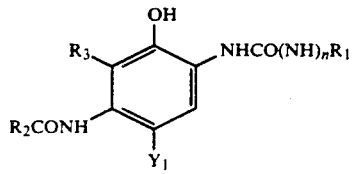

(I)

-continued (II)

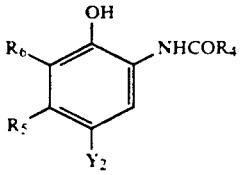

(III)

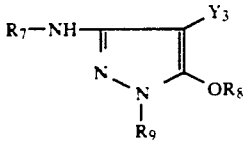

(IV)

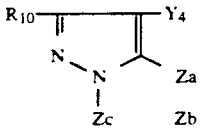

(V)

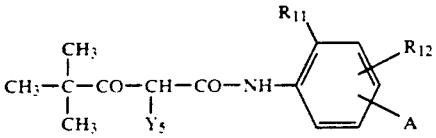

In general formulae (I) and (II), $R_1$, $R_2$ and $R_4$ represent substituted or unsubstituted aliphatic, aromatic or heterocyclic groups; $R_3$, $R_5$ and $R_6$ represent hydrogen atoms, halogen atoms, aliphatic groups, aromatic groups or acylamino groups, and $R_3$ may represents a group of non-metal atoms which, together with $R_2$, forms a five or six membered nitrogen containing ring. $Y_1$ and $Y_2$ represent hydrogen atoms or groups which can be eliminated at the time of the coupling reaction with the oxidized form of a developing agent.

$R_5$ in general formula (II) is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl.

More preferred examples of cyan couplers represented by the aforementioned general formula (I) or (II) are described below.

$R_1$ in general formula (I) is preferably an aryl group or a heterocyclic group, and aryl groups substituted with halogen atoms, alkyl groups, alkoxy groups, aryloxy groups, acylamino groups, acyl groups, carbamoyl groups, sulfonamido groups, sulfamoyl groups, sulfonyl groups, sulfamido groups, oxycarbonyl groups and cyano groups; are especially desirable.

In cases where $R_3$ and $R_2$ in general formula (I) do not form a ring, $R_2$ is preferably a substituted or unsubstituted alkyl group or aryl group, and most desirably a substituted aryloxy substituted alkyl group, and $R_3$ is preferably a hydrogen atom.

$R_4$ in general formula (II) is preferably a substituted or unsubstituted alkyl group or aryl group, and most desirably a substituted aryloxy substituted alkyl group.

$R_5$ in general formula (II) is preferably an alkyl group which has from 2 to 15 carbon atoms or a methyl group which has a substituent group which has at least 1 carbon atom, with the preferred substituent groups being arylthio groups, alkylthio groups, acylamino groups, aryloxy groups and alkyloxy groups.

$R_5$ in general formula (II) is most desirably an alkyl group which has from 2 to 15 carbon atoms, and alkyl group which have from 2 to 4 carbon atoms are especially desirable.

$R_6$ in general formula (II) is preferably a hydrogen atom or a halogen atom, and most desirably a chlorine atom or a fluorine atom.

$Y_1$ and $Y_2$ in general formulae (I) and (II) each preferably represents a hydrogen atom, a halogen atom, an alkoxy group, an aryloxy an acyloxy group or a sulfonamido group.

In general formula (III), $R_7$ and $R_9$ represent aryl groups, $R_8$ represents a hydrogen atom, an aliphatic or aromatic acyl group, or an aliphatic or aromatic sulfonyl group, and $Y_3$ represents a hydrogen atom or a releasing group. The substituent groups permitted for the aryl groups (preferably phenyl groups) represented by $R_7$ and $R_9$ are the same as those permitted as substituent groups for $R_1$. When there are two or more substituent groups, they may be the same or different. $R_8$ is preferably a hydrogen atom, an aliphatic acyl group or a sulfonyl group, and most desirably, a hydrogen atom. $Y_3$ is preferably a group of the type which is eliminated at a sulfur, oxygen or nitrogen atom. and most desirably, a sulfur atom releasing group of the type disclosed, for example, in U.S. Pat. No. 4,351,897 or WO88/04795.

In general formula (IV), $R_{10}$ represents a hydrogen atom or a substituent group. $Y_4$ represents a hydrogen atom or a releasing group, preferably a halogen atom or a arylthio group, Za, Zb and Zc represent methine groups, substituted methine groups, =N—groups or —NH—groups, and one of the bonds Za—Zb and Zb—Zc is a double bond and the other is a single bond. Those cases where Zb—Zc is a carbon—carbon double bond include those situations in which this bond is part of an aromatic ring. Cases where a dimer or larger oligomer is formed via $R_{10}$ or $Y_4$, and cases in which Za, Zb or Zc is a substituted methine group and a dimer or larger oligomer is formed via the substituted methine group, are included.

Among the pyrazoloazole based couplers represented by general formula (IV), the imidazo[1,2-b]pyrazoles disclosed in U.S. Pat. No. 4,500,630 are preferred from the point of view of the slight absorbance on the yellow side and the light fastness of the colored dye. The pyrazolo[1,5-b] [1,2,4]triazole disclosed in U.S. Pat. No. 4,540,654 is especially desirable.

The use of the pyrazolotriazole couplers in which a branched alkyl group is bonded directly to the 2-, 3- or 6-position of the pyrazolotriazole ring (see JP-A-61-65245), pyrazoloazole couplers which have a sulfonamide group within the molecule (see JP-A-61-65246), pyrazoloazole couplers which have alkoxyphenylsulfonamido ballast groups (see JP-A-61-147254), and pyrazolotriazole couplers which have an alkoxy group or an aryloxy group in the 6-position (see European Patent Publication No. 226,849), are also desirable.

In general formula (V), $R_{11}$ represents a halogen atom or an alkoxy group, and $R_{12}$ represents a hydrogen atom, a halogen atom or an alkoxy group. A represents $-NHCOR_{13}$, $-NHSO_2-R_{13}$, $-SO_2NHR_{13}$, $-COOR_{13}$ or $$-SO_2\underset{\underset{R_{14}}{|}}{N}-R_{13},$$

where $R_{13}$ and $R_{14}$ each represents an alkyl group. $Y_5$ represents a releasing group. The substituent groups for $R_{12}$, and $R_{13}$, $R_{14}$, are the same as the substituent groups permitted for $R_1$, and the releasing group $Y_5$ is preferably a group of the type at which elimination occurs at an oxygen atom or nitrogen atom, most desirably it is of the nitrogen atom elimination type.
Actual examples of couplers which can be represented by general formulae (I)-(V) are indicated below.
(C-1)
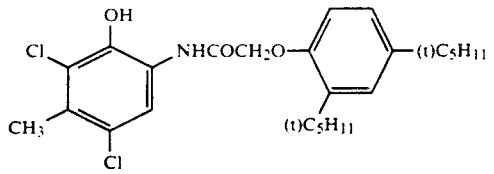
(C-2)
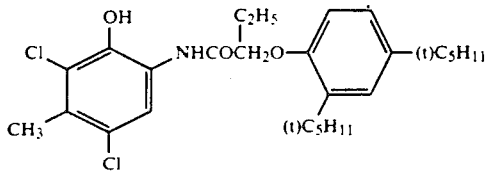
(C-3)
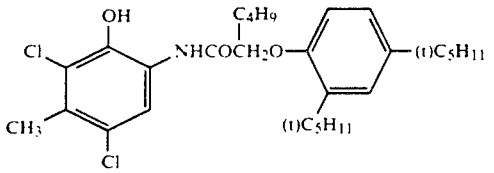
(C-4)
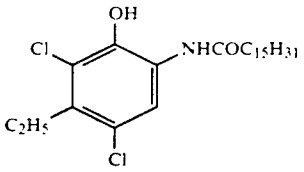
(C-5)
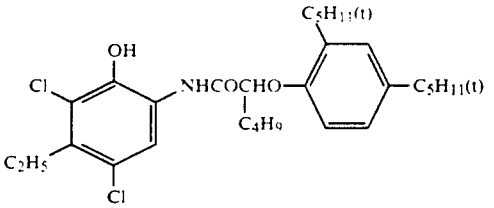
(C-6)
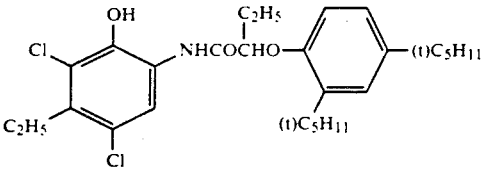
(C-7)
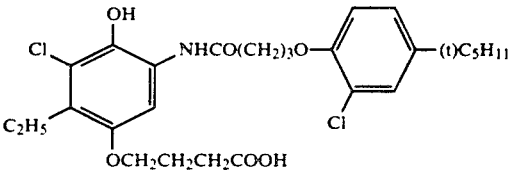
(C-8)
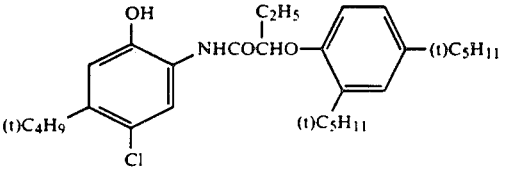

-continued
(C-9)
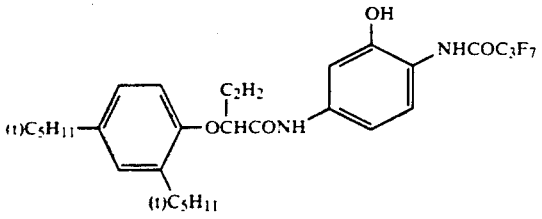
(C-10)
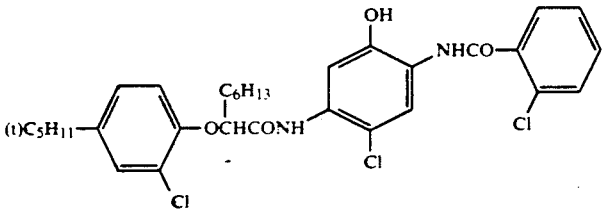
(C-11)
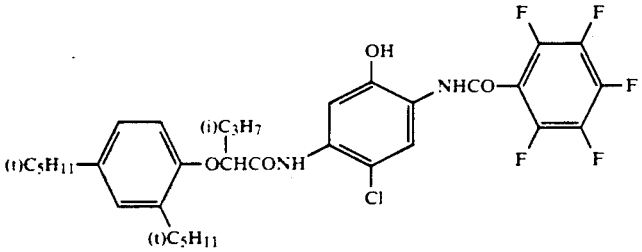
(C-12)
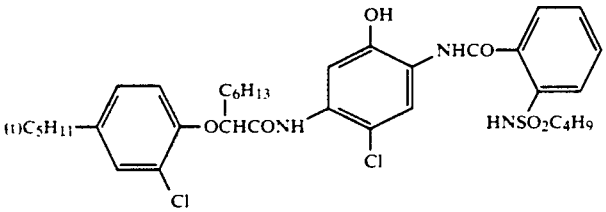
(C-13)
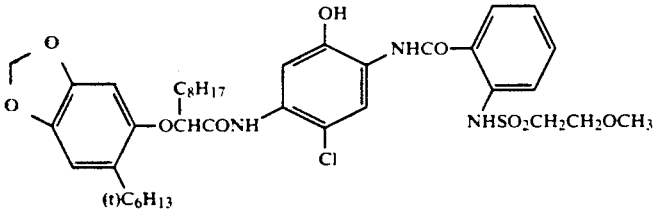
(C-14)
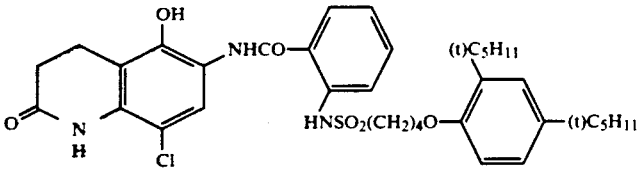
(C-15)
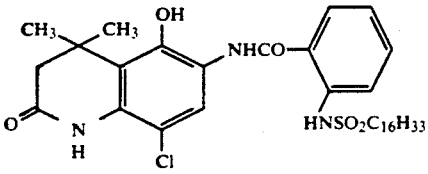

-continued
(C-16)
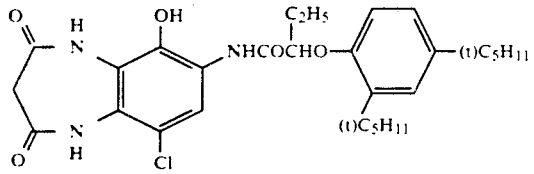
(C-17)
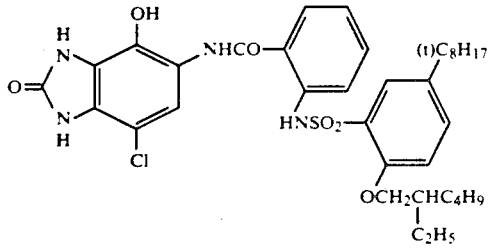
(C-18)
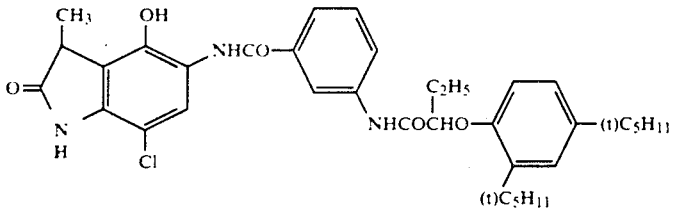
(C-19)
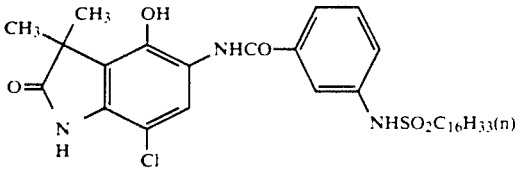
(C-20)
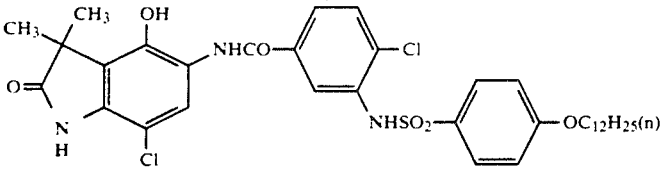
(C-21)
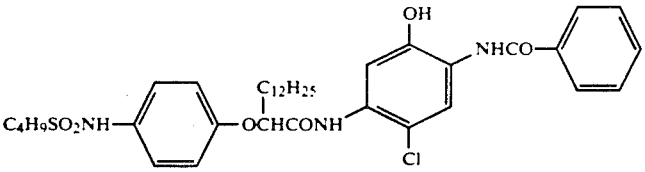
(C-22)
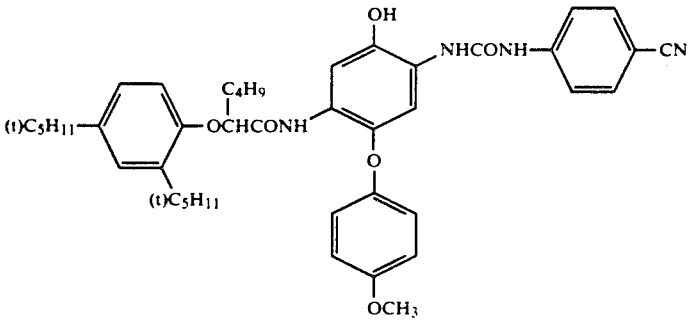

-continued
(M-1)
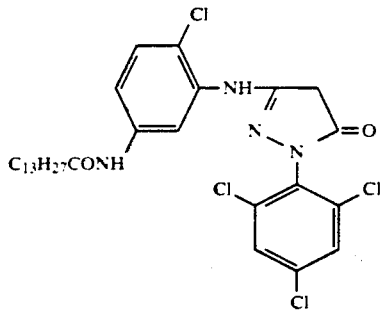
(M-2)
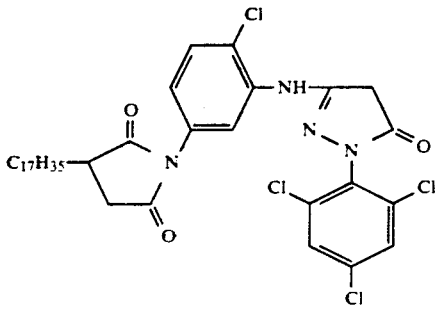
(M-3)
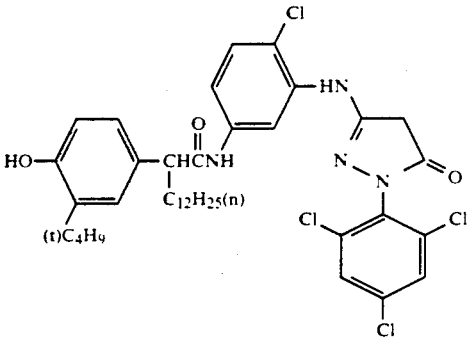
(M-4)
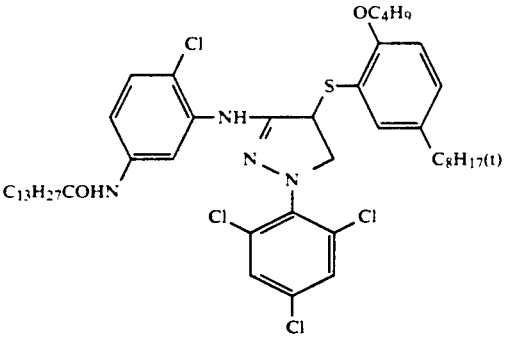
(M-5)
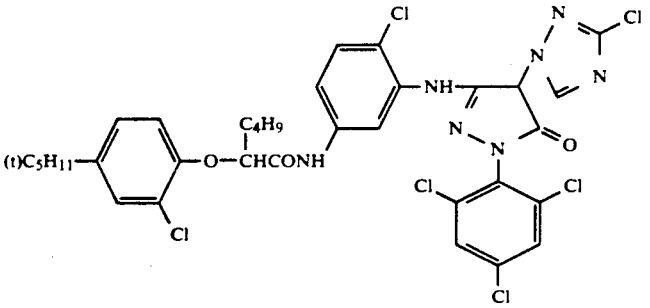

-continued
(M-6)
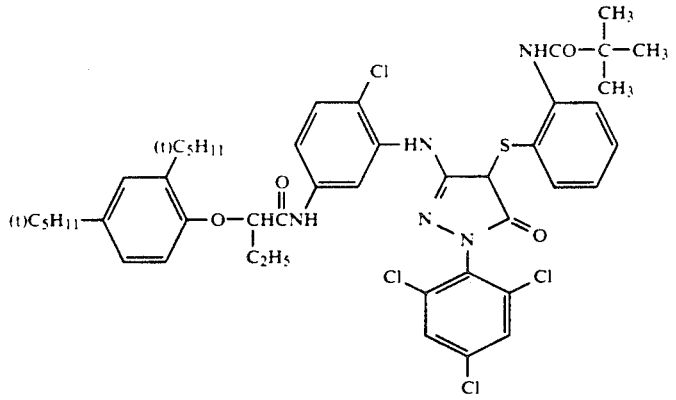
(M-7)
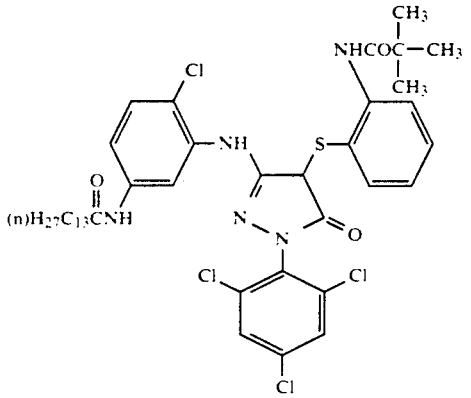
(M-8)
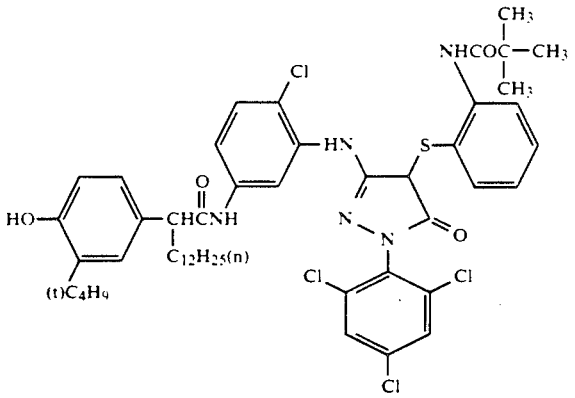
(M-9)
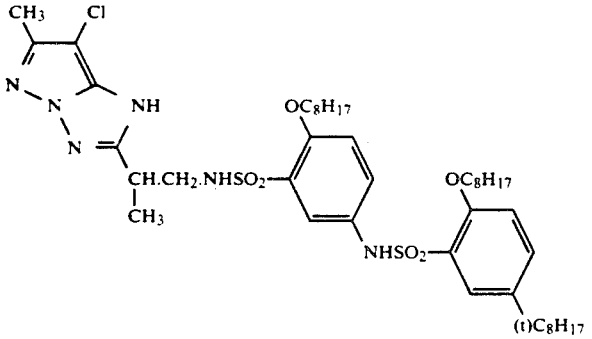

-continued
(M-10)
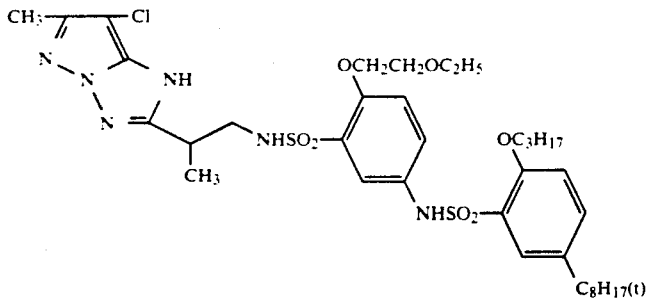
(M-11)
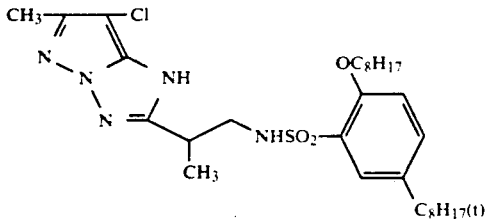
(M-12)
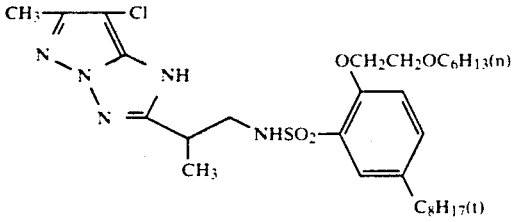
(M-13)
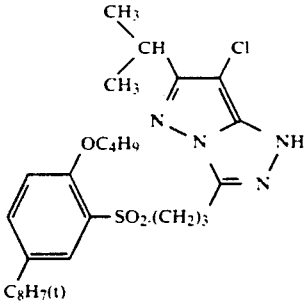
(M-14)
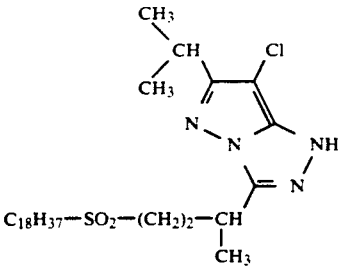
(M-15)
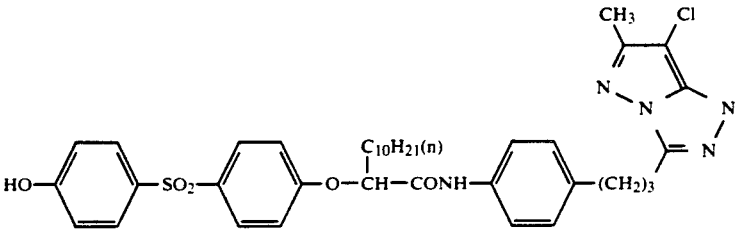

-continued
(M-16)
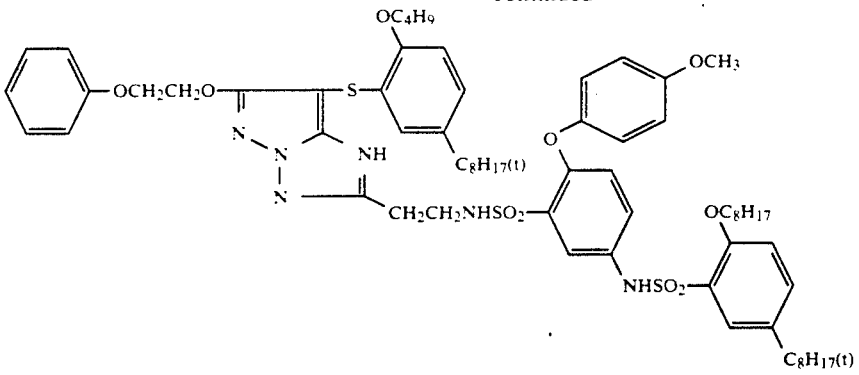
(M-17)
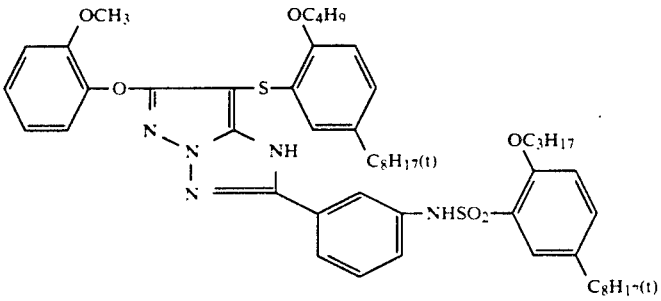
(M-18)
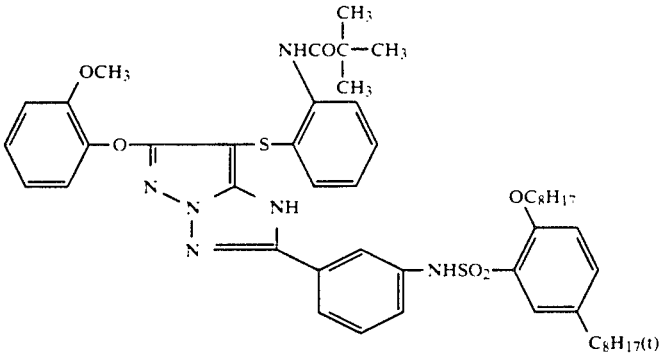
(Y-1)
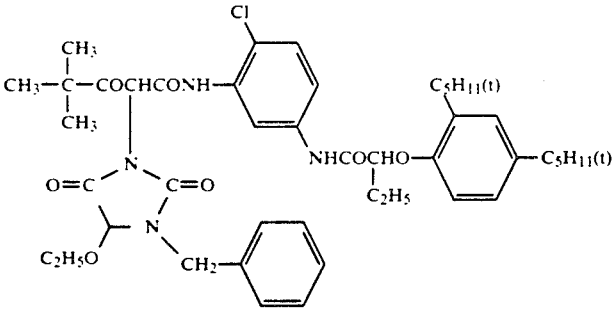
(Y-2)
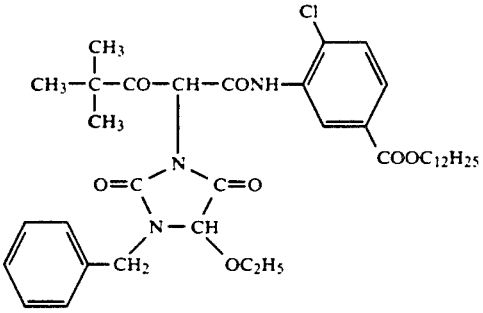

-continued
(Y-3)
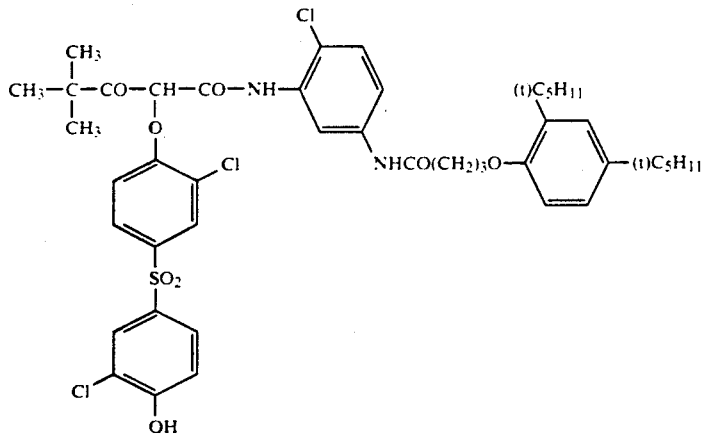
(Y-4)
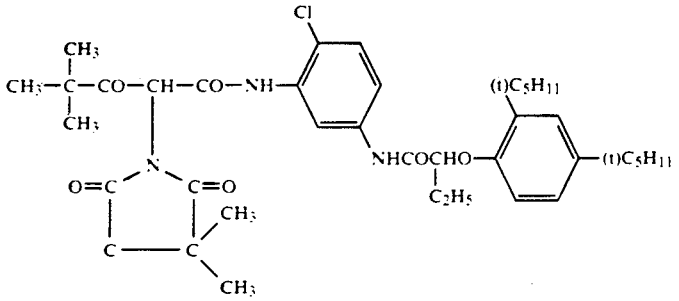
(Y-5)
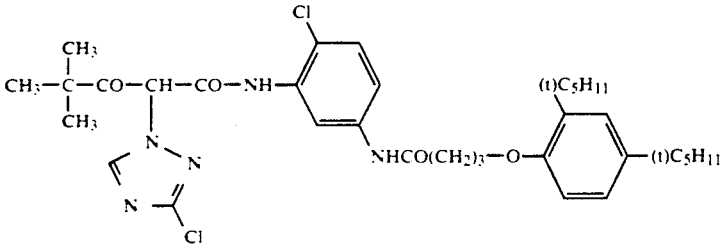
(Y-6)
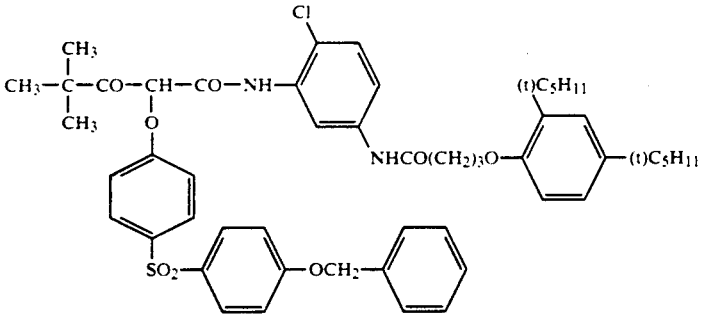
(Y-7)
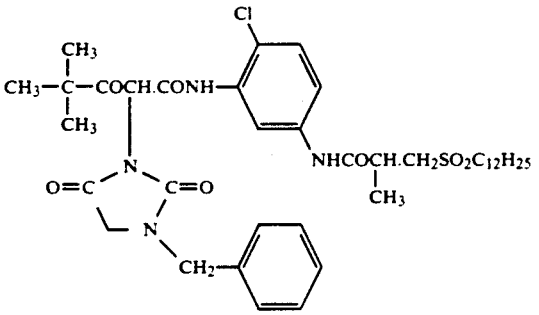

-continued (Y-8)

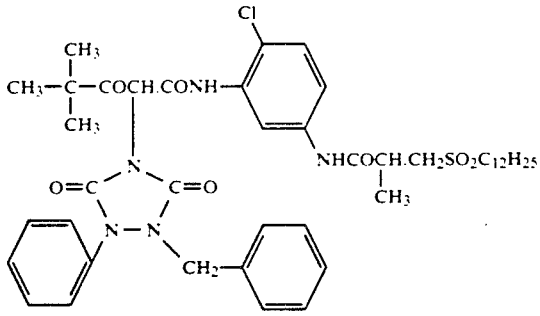

The couplers represented by the aforementioned general formulae (I) to (V) would normally be included in the silver halide emulsion layers which form the photosensitive layer at rates of from 0.1 to 1.0 mol, and preferably at rates of from 0.1 to 0.5 mol, per mol of silver halide.

Various techniques can be used for adding the aforementioned couplers to the photosensitive layers. They could be added by means of the oil in water dispersion method which is well known as the oil protection method, and after being dissolved in a solvent, the solution is emulsified and dispersed in an aqueous gelatin solution which contains a surfactant. Alternatively, water or an aqueous gelatin solution can be added to a coupler solution which contains a surfactant wherein an oil in water dispersion is formed by phase reversal. Furthermore, alkali soluble couplers can be dispersed using the so-called Fischer dispersion method. The coupler dispersions can be mixed with the photographic emulsions after removal of low boiling point organic solvents by distillation, noodle washing or ultrafiltration for example.

The use of high boiling point organic solvents which have dielectric constants (25° C.) of from 2 to 20, and refractive indices (25° C.) of from 1.3 to 1.7, and/or water insoluble polymeric compounds as coupler dispersion media are preferred.

Using high boiling point organic solvents represented by general formulae (A)-(E) indicated below are preferred.

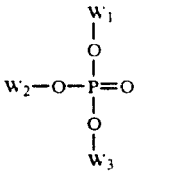

(A)

$W_1—COO—W_2$ (B)

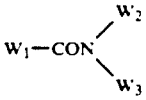

(C)

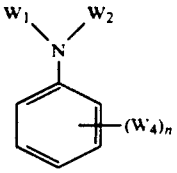

(D)

-continued $W_1—O—W_2$ (E)

In the above formulae, $W_1$, $W_2$ and $W_3$ each represent a substituted or unsubstituted alkyl group, cycloalkyl group, alkenyl group, aryl group or heterocyclic group, $W_4$ represents $W_1$, $OW_1$ or $S—W_1$, and n represents an integer of value from 1 to 5, and when n has a value of 2 or more the $W_4$ groups may be the same or different. Moreover, W and $W_2$ in general formula (E) may form a condensed ring.

Water immiscible compounds having a melting point below 100° C. and boiling point at least 140° C., other than those represented by general formulae (A)-(E), can be used as the high boiling point organic solvents provided that the coupler has a good solubility therein. The melting point of the high boiling point organic solvent is preferably not more than 80° C. Moreover, the boiling point of the high boiling point organic solvent is preferably at least 160° C., and most desirably at least 170° C.

Details regarding high boiling point organic solvents can be found between the lower right column on page 137 and the upper right column on page 144 of JP-A-62-215272.

Furthermore, the couplers can be loaded onto a loadable latex polymer (see, e.g., U.S. Pat. No. 4,203,716) in the presence or absence of the aforementioned high boiling point organic solvents. They can also be dissolved in a water insoluble but organic solvent soluble polymer and then emulsified and dispersed in an aqueous hydrophilic colloid solution.

Use of the homopolymers and copolymers disclosed on pages 12-30 of the specification of International Patent WO88/00723 is preferred, particularly if the use of acrylamide based polymers is desirable for color image stabilization.

Photographic materials which have been prepared according to the present invention may contain hydroquinone derivatives, aminophenol derivatives, gallic acid derivatives and ascorbic acid derivatives as anti-color fogging agents.

Various anti-color fading agents can be used in the photographic materials of the present invention. That is, hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines, and ether and ester derivatives in which the phenolic hydroxyl groups of these compounds have been silylated or alkylated, are typical organic anti-color fading agents, which can be used for cyan, magenta and/or yellow images. Furthermore, metal complexes such as (bis-salicylaldoximato)nickel and (bis-N,N-dialkyldithiocarbamato)nickel complexes, can also be used for this purpose.

Actual examples of organic anti-color fading agents include the hydroquinones disclosed in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028; the 6-hydroxychromans, 5-hydroxychromans and spirochromans disclosed in U.S. Pat. Nos. 3,432,300, 3,573,050, 3,574,627, 3,698,909 and 3,764,337, and JP-A-52-152225; the spiroindanes disclosed in U.S. Pat. No. 4,360,589; the p-alkoxyphenols disclosed in U.S. Pat. No. 2,735,765, British Patent 2,066,975, JP-A-59-10539 and JP-B-57-19765; the hindered phenols disclosed in U.S. Pat. No. 3,700,455, JP-A-52-72224, U.S. Pat. No. 4,228,235, and JP-B-52-6623; the gallic acid derivatives, methylenedioxybenzenes and aminophenols disclosed in U.S. Pat. Nos. 3,457,079 and 4,332,886, and JP-B-56-21144 respectively; the hindered amines disclosed in U.S. Pat. Nos. 3,336,135 and 4,268,593, British Patent Nos. 1,354,313 and 1,410,846, JP-B-51-1420, JP-A-58-114036, JP-A-59-53846 and JP-A-59-78344; and the metal complexes disclosed in U.S. Pat. Nos. 4,050,938 and 4,241,155, and British Patent 2,027,731(A). These compounds can be used to achieve their intended purpose by addition to the photosensitive layer after coemulsification with the corresponding color coupler, usually in an amount of from 5 to 100 wt.% based on the coupler.

The inclusion of ultraviolet absorbers in the cyan color forming layer, and in the layers on both sides adjacent thereto, is effective for preventing degradation of the cyan dye image by heat, and especially by light. Examples of such absorbers include benzotriazole compounds substituted with aryl groups (see, e.g., U.S. Pat. No. 3,533,794), 4-thiazolidone compounds (see e.g., U.S Pat. Nos. 3,314,794 and 3,352,681), benzophenone compounds (see e.g., JP-A-46-2784), cinnamic acid ester compounds (see e.g., U.S. Pat. Nos. 3,705,805 and 3,707,375), butadiene compounds (see e.g., U.S. Pat. No. 4,045,229), or benzoxidol compounds (see e.g., U.S. Pat. No. 3,700,455). Ultraviolet absorbing couplers (for example, α-naphthol based cyan dye forming couplers) and ultraviolet absorbing polymers can also be used for this purpose. The ultraviolet absorbers can be mordanted in a specified layer. The aforementioned benzotriazole compounds, substituted with aryl groups, are preferred.

Using the above-described couplers with compounds such as those described below is a preferred embodiment of the present invention. The conjoint use of the compounds with pyrazoloazole couplers is especially desirable.

The use of compounds (F) which bond chemically with aromatic amine based developing agents remaining after color development processing to form compounds which are chemically inert and essentially colorless, and/or compounds (G) which bond chemically with the oxidized form of aromatic amine based color developing agents remaining after color development processing to form compounds which are chemically inert and essentially colorless either simultaneously or individually, is desirable for preventing the occurrence of staining and other side effects upon storage due to colored dye formation resulting from the reaction of couplers with color developing agents or oxidized forms thereof which remain in the film after processing, Compounds which react with p-anisidine with a second order reaction rate constant $k_1$ (measured in trioctyl phosphate at 80° C.) within the range from 1.0 liter/mol.sec to $1 \times 10^{-5}$ liter/mol.sec, are preferred for compound (F). The second order reaction rate constants can be measured using the method disclosed in JP-A-63-158545.

The compounds are themselves unstable if $K_2$ has a value above the aforementioned range. They will react with gelatin or water and decompose. If, on the other hand, the value of $k_2$ falls below the range, reaction with residual aromatic amine based developing agents is slow. Consequently, it is not possible to prevent the occurrence of the side effects from the residual aromatic amine based developing agents.

Preferred compounds (F) are represented by the general formulae (FI) and (FII) set forth below.

$$R_1-(A)_n-X \qquad \text{(FI)}$$

$$R_2-\underset{\underset{B}{|}}{C}=Y \qquad \text{(FII)}$$

In the above formulae, $R_1$ and $R_2$ each represent an aliphatic group, an aromatic group or a heterocyclic group. Moreover, n represents 1 or 0. A represents a group which reacts with aromatic amine based developing agents and forms a chemical bond, and X represents a group which is eliminated by reaction with an aromatic amine based developing agent. B represents a hydrogen atom, an aliphatic group, an aromatic group, a heterocyclic group, an acyl group or a sulfonyl group, and Y represents a group which accelerates the addition of the aromatic amine based developing agent to the compound of general formula (FII). Here, $R_1$ and X, and Y and $R_2$ or B, can be joined together to form a cyclic structure.

Substitution reactions and addition reactions are typical of the reactions by which the residual aromatic amine based developing agents are chemically bound.

Actual examples of compounds represented by general formulae (FI) and (FII) can be found, for example, in JP-A-63-158545, JP-A-62-283338, and European Patent Publication Nos. 277,589 and 298,321 are preferred.

On the other hand, preferred compounds (G) which chemically bond with the oxidized form of the aromatic amine based developing agents which remain after color development processing and form compounds which are chemically inert and colorless, are represented by general formula (GI) below:

$$R-Z \qquad \text{(GI)}$$

In the above formula, R represents an aliphatic group, an aromatic group or a heterocyclic group. Z represents a nucleophilic group or a group which breaks down in the photographic material and releases a nucleophilic group. The compounds represented by the general formula (GI) are preferably compounds in which Z is a group of which the Pearson nucleophilicity $^{n}CH_3I$ value (R. G. Pearson et al., *J. Am. Chem. Soc.*, 90, 319 (1968)) is at least 5, or a group derived therefrom. Actual examples of compounds represented by general formula (GI) can be found in European Patent Publication Nos. 255,722, 277,589 and 298,321, JP-A-62-143048, JP-A-62-229145, JP-A-1-57259 and Japanese Patent Application No. 63-136724 preferred.

Furthermore, details of combinations of compounds (G) and compounds (F) are disclosed in European Patent Publication No. 277,589.

Water soluble dyes can be included as filter dyes, for anti-irradiation purposes or for various other purposes in hydrophilic colloid layers of the photographic materials. Dyes of this type include oxonol dyes, hemi-oxonol dyes, styryl dyes, merocyanine dyes, cyanine dyes and azo dyes. The oxonol dyes, hemi-oxonol dyes and merocyanine dyes are especially useful.

The use of Gelatin as the binding agent or protective colloid in the photosensitive layers of photographic materials of the present invention is convenient, but other hydrophilic colloids, either alone or in conjunction with gelatin, can be used for this purpose.

The gelatin used in the invention may be a lime treated gelatin, or it may be a gelatin which has been treated using acids. Details of the preparation of gelatins have been disclosed by Arthur Weise in *The Macromolecular Chemistry of Gelatin*, (published by Focal Press, 1964).

Transparent films, such as cellulose nitrate films and poly(ethylene terephthalate) films, and reflective supports normally used in photographic materials, can be used for the supports used in the present invention. The use of reflective supports is preferred, The "reflective supports" have a high reflectivity and the dye image which is formed in the silver halide emulsion layer is bright. Supports which have been covered with a hydrophobic resin which contains a dispersion of a light reflecting material, such as titanium oxide, zinc oxide, calcium carbonate or calcium sulfate for increasing the reflectance in the visible wavelength region, and supports comprising a hydrophobic resin which contains a dispersion of a light reflecting substance, are included among such reflective supports. Examples of such supports include baryta paper, polyethylene coated paper, polypropylene based synthetic paper and transparent supports, such as glass plates, polyester films, such as poly(ethylene terephthalate), cellulose triacetate and cellulose nitrate films, polyamide films, polycarbonate films, polystyrene films, and vinyl chloride resins on which a reflective layer has been established or in which a reflective substance is combined. The support can be selected appropriately according to the intended application of the material.

The use of a white pigment which has been milled adequately in the presence of a surfactant and of which the surface of the pigment particles has been treated with a dihydric, trihytdric or tetrahydric alcohol, is preferred for the light reflecting substance.

The occupied surface ratio of fine white pigment particles per specified unit area (%) can be determined most typically by dividing the area under observation into adjoining 6 × 6 μm unit areas and measuring the occupied area ratio (%) ($R_i$) for the fine particles projected in each unit area. The variation coefficient of the occupied area ratio (%) can be obtained by means of the ratio $s/\bar{R}$ of the standard deviation s of $R_i$ with respect to the average value ($\bar{R}$) of $R_i$. The number of unit areas taken for observation (n) is preferably at least six. Hence, the variation coefficient can be obtained from the expression:

$$\sqrt{\frac{\sum_{i=1}^{n}(R_i - R)^2}{n-1}} \Big/ \frac{\sum_{i=1}^{n} R_i}{n}$$

In the present invention, the variation coefficient of the occupied area ratio (%) of the fine pigment particles is not more than 0.15, and preferably not more than 0.12. When this value is less than 0.08 the dispersivity of the particles in practice can be said to be uniform.

The color development baths used during development processing of the photographic materials of the invention are preferably aqueous alkaline solutions which contain a primary aromatic amine based color developing agent as the principal component. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, according to the intended purpose.

Color development baths generally contain pH buffers such as alkali metal carbonates, borates or phosphates, and development inhibitors or anti-foggants such as bromides, iodides, benzimidazoles, benzothiazoles or mercapto compounds. They may also contain, as required, various preservatives such as hydroxylamine, diethylhydroxylamine, sulfites, hydrazines, phenylsemicarbazides, triethanolamines, catecholsulfonic acids and triethylenediamine(1,4-diazabicyclo[2,2,2]octane) compounds, organic solvents such as ethylene glycol and diethylene glycol, development accelerators such as benzyl alcohol, polyethylene glycol, quaternary ammonium salts and amines, color forming couplers, competitive couplers, fogging agents such as sodium borohydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts of these acids.

Color development is carried out after a normal black and white development in cases where reversal processing is carried out. The known black and white developers, for example dihydroxybenzenes such as hydroquinone, 3-pyrazolidones such as 1-phenyl-3-pyrazolidone or aminophenols such as N-methyl-p-aminophenol, can be used individually, or in combination, in the black and white development bath.

The pH of the color development baths and black and white development bath is generally within the range from 9 to 12. The replenishment amounts of the development baths depend on the color photographic material which is being processed, but it is generally less than 3 liters per square meter of photographic material. Replenishment amounts of less than 500 ml per square meter of photographic material can be achieved by reducing the bromide ion concentration in the replenisher. The prevention of evaporation or aerial oxidation of the liquid by minimizing the area of contact between the processing bath and the atmosphere is desirable in those cases in which the rate of replenishment is low. Furthermore, the replenishment amount can be reduced by using some means of suppressing the accumulation of bromide ion in the development bath.

The photographic emulsion layer is subjected to a normal bleaching process after color development. The bleaching process may be carried out at the same time as a fixing process (a bleach-fix process) or it may be carried out as a separate process. Moreover, processing methods in which a bleach-fix process is carried out after a bleaching process, can be used in order to speed up processing. Moreover, processing can be carried out in two connected bleach-fix baths; a fixing process can be carried out before a bleach-fixing process, or a bleaching process can be carried out after a bleach-fix process. Compounds of multivalent metals, such as iron(III), cobalt (III), chromium(VI) and copper(II), peracids, quinones and nitro compounds, for example, can be used as bleaching agents. Typical bleaching agents include ferricyanides; dichromates; organic complex salts of iron(III) or cobalt(III) such as complex salts with aminopolycarboxylic acids (e.g., ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid) with citric acid, tartaric acid or malic acid; persulfates; permanganates; and nitrobenzenes. From among these materials, the use of the polyaminocarboxylic acid iron(III) complex salts, principally ethylenediamine tetra-acetic acid iron(III) complex salts, and persulfates, is preferred because they provide rapid processing and the prevention of environmental pollution. Moreover, the aminopolycarboxylic acid iron(III) complex salts are. especially useful in both bleach baths and bleach-fix baths. The pH of the bleach baths and bleach-fix baths in which these aminopolycarboxylic acid iron(III) salts are used is normally from 5.5 to 8, but lower pH values can be used in order to speed up processing.

Bleaching accelerators can be used, as required, in the bleach baths, bleach-fix baths or bleach or bleach-fix pre-baths. Actual examples of useful bleach accelerators have been disclosed in the following documents. There are the compounds which have a mercapto group or a disulfide bond disclosed in U.S. Pat. No. 3,893,858, West German Patent 1,290,812, JP-A-53-95630, and *Research Disclosure* No. 17129 (Jul. 1978); thiazolidine derivatives disclosed in JP-A-50-140129; thiourea derivatives disclosed in U.S. Pat. No. 3,706,561; iodides disclosed in JP-A-58-16235; polyoxyethylene compounds disclosed in West German Patent No. 2,748,430; polyamine compounds disclosed in JP-B-45-8836; and bromide ion. From among these compounds, those which have a mercapto group or a disulfide group are preferred due to their large accelerating effect. The compounds disclosed in U.S. Pat. No. 3,893,858, West German Patent No. 1,290,812 and JP-A-53-95630 are especially desirable. Moreover, the compounds disclosed in U.S. Pat. No. 4,552,834 are also desirable. Bleach accelerators may also be included in photographic materials. The bleach accelerators are especially effective when bleach-fixing color photographic picture-taking materials.

Thiosulfates, thiocyanates, thioether based compounds, thioureas and large amounts of iodide can be used as fixing agents, but thiosulfates are normally used. Ammonium thiosulfate can be used in the widest range of applications. Sulfites and bisulfites, or carbonyl/bisulfite addition compounds, are the preferred preservatives for bleach-fix baths.

The silver halide color photographic materials of the invention are usually subjected to a water washing process and/or stabilization process after de-silvering. The amount of wash water used in washing can be fixed within a wide range, depending on the application and the nature (e.g., materials in which couplers which have been used) of the photographic material, the wash water temperature, the number of water washing tanks (the number of water washing stages), the replenishment system (i.e., whether a counter flow or a sequential flow system is used), and various other conditions. The relationship between the amount of water used and the number of washing tanks in a multi-stage counter-flow system can be obtained using the method set forth on pages 248–253 of the *Journal of the Society of Motion Picture and Television Engineers*, Vol. 64 (May 1955).

The amount of wash water can be greatly reduced by using the multi-stage counter-flow system described in the aforementioned literature, but bacteria proliferate due to the increased residence time of the water in the tanks. Problems arise with the suspended matter, which is produced, becoming attached to the photographic material. A method in which calcium ion and magnesium ion concentrations are reduced is very effective as a means of overcoming this problem when processing the color photographic materials of the present invention (see JP-A-62-288838). Furthermore, the isothiazolone compounds and thiabendazoles disclosed in JP-A57-8542, chlorine based disinfectants such as chlorinated sodium isocyanurate, and benzotriazole, and the disinfectants disclosed in "*The Chemistry of Biocides and Fungicides*" by Horiguchi, in "*Killing Micro-organisms, Biocidal and Funcicidal Techniques*" published by the Health and Hygiene Technical Society, and in "*A Dictionary of Biocides and Fungicides*" published by the Japanese Biocide and Fungicide Society, can also be used in this regard.

The pH value of the wash water used for processing the photographic materials of the invention is from 4 to 9, and preferably from 5 to 8. The washing water temperature and the washing time can be set variously in accordance with the nature and application of the photographic material. In general, however, washing conditions of from 20 seconds to 10 minutes at a temperature of from 15° C. to 45° C., preferably of from 30 seconds to 5 minutes at a temperature of from 25° C to 40° C., are used. Moreover, the photographic materials of this invention can be processed directly in a stabilizing bath instead of being subjected to a water wash as described above. The known methods disclosed in JP-A-57-8543, JP-A-58-14834 and JP-A-60-220345 can be used for this purpose.

In some cases a stabilization process can be carried out following the aforementioned water washing process. Stabilizing baths which contain formalin and surfactant which are used as final baths with color camera photographic materials are an example of such a process. Various chelating agents and fungicides can also be added to these stabilizing baths.

The overflow which accompanies replenishment of the above mentioned water washing or stabilizing baths, can be reused in other operations such as the de-silvering process.

Color developing agents can be incorporated into the silver halide color photographic material of the invention in order to simplify and speed up processing. The incorporation of various color developing agent precursors is preferred. Examples include the indoaniline based compounds disclosed in U.S. Pat. No. 3,342,597, the Shiff's base-type compounds disclosed in U.S. Pat. No. 3,342,599, *Research Disclosure* No. 14850 and *ibid*, No. 15159, the aldol compounds disclosed in *Research Disclosure* No. 13924, the metal complex salts disclosed in U.S. Pat. No. 3,719,492 and the urethane based compounds disclosed in JP-A-53-135628.

Various 1-phenyl-3-pyrazolidones can be incorporated, as required, into the silver halide color photographic materials of the invention with a view to accelerating color development. Typical compounds of this type have been disclosed, for example, in JP-A-56-64339, JP-A-57-144547 and JP-A-58-115438.

The various processing baths are used at temperatures ranging from 10° C. to 50° C. The standard temperature is normally from 33° C. to 38° C., but accelerated processing and shorter processing times can be realized at higher temperatures. On the other hand, increased picture quality and better processing bath stability can be achieved at lower temperatures. Furthermore, processes using hydrogen peroxide intensification or cobalt intensification such as those disclosed in West German Patent No. 2,226,770 or U.S. Pat. No. 3,674,499 can be used in order to economize on silver in the photographic material. In the interest of brevity and conciseness, the contents of the aforementioned numerous patents and articles are hereby incorporated by reference.

The present invention will be explained in further detail with reference to the following examples. These examples, however, should not be considered to be in any way limiting.

EXAMPLE 1

Table 1 shows the silver halide emulsions which were prepared for comparison purposes, and according to the present invention.

Preparation of Emulsion (A)

To 500 ml of a 3 wt% aqueous solution of lime-treated gelatin there were added 6.4 g of sodium chloride and 3.2 ml of a 1 wt% aqueous solution of N,N'-dimethyl-imidazolidine-2-thione. This aqueous solution was kept at 55° C., and 250 ml of an aqueous solution containing 0.2 mol of silver nitrate, and 250 ml of an aqueous solution containing 0.16 mol of potassium bromide, 0.04 ml of sodium chloride, and 0.2 mg of potassium iridate(IV) chloride were added during 20 minutes, with stirring, by the double jet method (first step). Furthermore, 500 ml of an aqueous solution containing 0.8 mol of silver nitrate, and 500 ml of an aqueous solution containing 0.64 mol of potassium bromide, 0.16 mol of sodium chloride, and 0.08 mg of potassium iridate(IV) chloride were added during 40 minutes (second step). After this, the emulsion was desalted by a normal flocculation method, 45 g of lime-treated gelatin were added, the whole was made up to 1 liter, and chemical sensitization was optimally performed using triethylthiourea.

Emulsions (J) to (M) were prepared by the same method as Emulsion (A), but the amounts of reagents and the temperature were varied as shown below. In preparation of Emulsion (M), third step was further conducted followed by the second step.

| Emulsion | Temperature (°C.) | First Step | | | Second Step | | | Third Step |
|---|---|---|---|---|---|---|---|---|
| (J) | 56 | $AgNO_3$ | 0.5 | mol | 0.5 | mol | | — |
| | | KBr | 0.425 | mol | 0.375 | mol | | — |
| | | NaCl | 0.075 | mol | 0.125 | mol | | — |
| (K) | 57 | $AgNO_3$ | 0.5 | mol | 0.5 | mol | | — |
| | | KBr | 0.45 | mol | 0.35 | mol | | — |
| | | NaCl | 0.05 | mol | 0.15 | mol | | — |
| (L) | 53 | $AgNO_3$ | 0.5 | mol | 0.5 | mol | | — |
| | | KBr | 0.35 | mol | 0.25 | mol | | — |
| | | NaCl | 0.15 | mol | 0.25 | mol | | — |
| (M) | 57 | $AgNO_3$ | 0.6 | mol | 0.2 | mol | | 0.2 mol |
| | | KBr | 0.54 | mol | 0.14 | mol | | 0.12 mol |
| | | NaCl | 0.06 | mol | 0.06 | mol | | 0.08 mol |

TABLE 1

| Emulsion | No. of Laminations | Total AgCl (mol %) | Each Layer AgCl (mol %) 1 | 2 | 3 | 4 | 5 | 1-2 Layer AgCl Difference (mol %) | Ag Mol Ratio of Each Layer | AgCl Distribution of Each Layer | Note |
|---|---|---|---|---|---|---|---|---|---|---|---|
| A | 1 | 20 | 20 | — | — | — | — | 0 | — | | Comparison |
| B | 1 | 20 | 20 | — | — | — | — | 0 | — | Completely Uniform | Comparison |
| C | 2 | 20 | 19 | 21 | — | — | — | 2 | 1/1 | Completely Uniform | Comparison |
| D | 2 | 20 | 15 | 25 | — | — | — | 10 | 1/1 | Completely Uniform | Invention |
| E | 2 | 20 | 16 | 36 | — | — | — | 20 | 4/1 | Completely Uniform | Invention |
| F | 2 | 20 | 10 | 30 | — | — | — | 20 | 1/1 | Completely Uniform | Invention |
| G | 2 | 40 | 30 | 50 | — | — | — | 20 | 1/1 | Completely Uniform | Invention |
| H | 2 | 20 | 30 | 10 | — | — | — | 20 | 1/1 | Completely Uniform | Invention |
| I | 2 | 20 | 5 | 35 | — | — | — | 30 | 1/1 | Completely Uniform | Comparison |
| J | 2 | 20 | 15 | 25 | — | — | — | 10 | 1/1 | | Comparison |
| K | 2 | 20 | 10 | 30 | — | — | — | 20 | 1/1 | | Comparison |
| L | 2 | 40 | 30 | 50 | — | — | — | 20 | 1/1 | | Comparison |
| M | 3 | 20 | 10 | 30 | 40 | — | — | 20 | 3/1/1 | | Comparison |
| N | 3 | 20 | 10 | 30 | 40 | — | — | 20 | 3/1/1 | Completely Uniform | Invention |
| O | 5 | 20 | 10 | 15 | 20 | 25 | 30 | 5 | 1/1/1/1/1 | Completely Uniform | Comparison |
| P | 2 | 20 | 10 | 30 | — | — | — | 20 | 1/1 | Completely Uniform | Invention |

(The emulsion grains in the table were all prepared with a cubic form, average grain size 0.45 to 0.47 μm, coefficient of variation 0.07 to 0.10)

Preparation of Emulsion (B)

Preparation of Fine Grain Emulsion (1)

To 1.3 liters of aqueous solution of 2.3 wt% of gelatin containing 0.06 mol of silver chloride were added 1 liter of aqueous solution containing 1.0 mol of silver nitrate and 1 liter of an aqueous solution containing 0.8 mol o potassium bromide, 0.2 mol of sodium chloride and 0.1 mg of potassium iridate(IV) chloride, by the double jet method during 25 minutes, with stirring. During this, the gelatin solution was kept at 35° C. in a reaction vessel. After this, the emulsion was desalted by flocculation, and 30 g of gelatin were added and dissolved. 1 Liter of a silver chlorobromide grain emulsion having a grain size of about 0.09 μm (silver chloride 20 mol%) was obtained.

Fine Grain Emulsion (2) was added in an amount corresponding to 0.5 mol of silver nitrate and mixed during 25 minutes with stirring (first step) Furthermore, after 10 minutes, Fine Grain Emulsion (3) was added in an amount corresponding to 0.5 mol of silver nitrate and mixed during 30 minutes with stirring (second step). 10 Minutes after the completion of addition of the fine grain emulsions, the temperature was lowered to 35° C., and desalting was performed by flocculation by the normal method. After the addition of 45 g of lime-treated gelatin, the whole was made up to 1 liter, and chemical sensitization was optimally performed with triethylthiourea.

Also, Emulsions (C), (E) to (I), (N), (0) were prepared by the same way as Emulsion (D), but changing the kinds and amounts of fine grain emulsions and the temperature as shown below.

| | | Fine Grain Emulsion Used | | | | | | | | | |
|---|---|---|---|---|---|---|---|---|---|---|---|
| | | First Step | | Second Step | | Third Step | | Fourth Step | | Fifth Step | |
| Emulsion | Temperature (°C.) | AgCl Content (mol %) | Amount Corresponding to $AgNO_3$ (mol) | AgCl Content (mol %) | Amount Corresponding to $AgNO_3$ (mol) | AgCl Content (mol %) | Amount Corresponding to $AgNO_3$ (mol) | AgCl Content (mol %) | Amount Corresponding to $AgNO_3$ (mol) | AgCl Content (mol %) | Amount Corresponding to $AgNO_3$ (mol) |
| (C) | 61 | 19 | 0.5 | 21 | 0.5 | — | — | — | — | — | — |
| (E) | 62 | 16 | 0.8 | 36 | 0.2 | — | — | — | — | — | — |
| (F) | 63 | 10 | 0.5 | 30 | 0.5 | — | — | — | — | — | — |
| (G) | 59 | 30 | 0.5 | 50 | 0.5 | — | — | — | — | — | — |
| (H) | 59 | 30 | 0.5 | 50 | 0.5 | — | — | — | — | — | — |
| (I) | 64 | 5 | 0.5 | 35 | 0.5 | — | — | — | — | — | — |
| (N) | 64 | 10 | 0.6 | 30 | 0.2 | 40 | 0.2 | — | — | — | — |
| (O) | 64 | 10 | 0.2 | 15 | 0.2 | 20 | 0.2 | 25 | 0.2 | 30 | 0.2 |

Preparation of Emulsion (B)

To 500 ml of a 3 wt% aqueous solution of lime-treated gelatin were added 20 g of sodium chloride and 3.2 ml of a 1 wt% aqueous solution of N,N'-dimethylimidazolidine-2-thione. The aqueous solution was kept at 60° C., and the above prepared Fine Grain Emulsion (1) was added in an amount corresponding to 1 mol of silver nitrate and mixed with stirring during 60 minutes. 10 minutes after the completion of addition of the fine grain emulsion, the temperature was lowered to 35° C., and desalting was performed by the normal flocculation method, after the addition of 45 g of lime-treated gelatin, the whole was made up to 1 liter, and chemical sensitization was optimally performed using triethylthiourea.

Preparation of Emulsion (D)

Preparation of Fine Grain Emulsion (2)

In the same manner as Fine Grain Emulsion (1), but changing the amounts of potassium bromide and sodium chloride, 1 liter of a silver grain emulsion having a grain size of about 0.08 μm (silver chloride 15 mol%) was obtained.

Preparation of Fine Grain Emulsion (3)

In the same manner as Fine Grain Emulsion (1), chloride, 1 liter of a silver chlorobromide emulsion having a grain size of about 0.09 μm (silver chloride 25 mol%) was obtained.

Preparation of Emulsion (D)

To 500 ml of 3 wt% aqueous solution of lime-treated gelatin were added 20 g of sodium chloride and 3.2 ml of a 1 wt% aqueous of N,N'-dimethylimidazolidine-2-thione. This aqueous solution was kept at 62° C. and Preparation of Emulsion (P)

The preparation was performed using the apparatus shown in FIG. 2.

In a reaction vessel, to 500 ml of a 3 wt% aqueous solution of lime-treated gelatin were added 14 g of sodium chloride and 3.2 ml of a 1 wt% aqueous solution of N,N'-dimethylimidazolidine-2-thione, and the temperature was kept at 55° C. In a strong, efficient mixing device, 300 ml of aqueous solution containing 0.5 mol of silver nitrate, 300 ml of an aqueous solution containing 0.45 mol of potassium bromide, 0.05 mol of sodium chloride and 0.05 mg of potassium iridate(IV) chloride and 300 ml of an aqueous solution containing 5 wt% of low molecular weight gelatin (average molecular weight 20,000) were added by the triple jet method during 25 minutes. The temperature of the mixing device was kept at 25° C. A very fine grain emulsion (average size 0.2 μm) was obtained from the stirred reaction in the mixing device, and was immediately and continuously introduced into the reaction vessel. After this, 300 ml of an aqueous solution containing 0.5 mol of silver nitrate, 300 ml of an aqueous solution containing 0.35 mol of potassium bromide, 0.15 mol of sodium chloride and 0.05 mg of potassium iridate(IV) chloride, and 300 ml of an aqueous solution containing 5 wt% of low molecular weight gelatin (average molecular weight 20,000) were added during 30 minutes by a triple jet method, and the solution was immediately and continuously introduced into the reaction vessel. 10 Minutes after the completion of addition, the temperature was lowered to 35° C., desalting was performed by a conventional flocculation method and, after the addition of 45 g of lime-treated gelatin, the whole was made up to 1 liter, and chemical sensitization was optimally performed using triethylthiourea.

After the above Emulsions (A) to (P) had been spectrally sensitized, a coupler emulsion and coating aid were added, and they were coated onto a polyethylene laminated paper support to prepare Samples (101) to (116) having the following layer constructions and compositions. The spectral sensitizer as below (Sen-1) was added in an amount of $2.1 \times 10^{-4}$ mol per mol of silver halide.

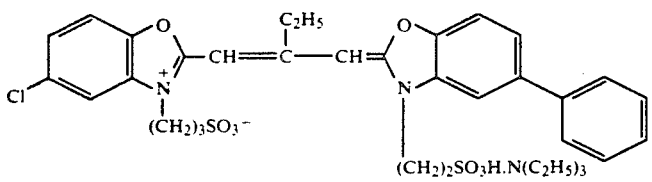

Layer Construction

The ingredients used and their coverages expressed in terms of $g/m^2$ are shown below, except that the silver halide emulsion is expressed on a silver basis.

Support

A polyethylene Laminated Paper (containing a white pigment ($TiO_2$) and a bluish dye (ultramarine) on the first layer side)

| | |
|---|---|
| First Layer: Green-Sensitive Silver Halide Layer | |
| Spectrally Sensitized Emulsion | 0.12 |
| Antifoggant (Cpd-1) | 0.001 |
| Magenta Coupler (Illustration M-12) | 0.28 |
| Color Image Stabilizer (Cpd-2) | 0.10 |
| Color Image Stabilizer (Cpd-3) | 0.08 |
| Color Image Stabilizer (Cpd-4) | 0.03 |
| Color Image Stabilizer (Cpd-5) | 0.004 |
| Solvent (Solv-1 and Solv-2 in volume ratio 1/2) | 0.65 |
| Gelatin | 1.47 |
| Second Layer: Protective Layer | |
| Gelatin | 1.50 |

(Cpd-1)

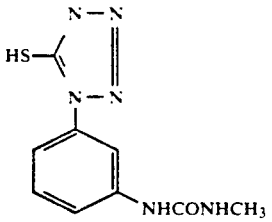

(Cpd-2)

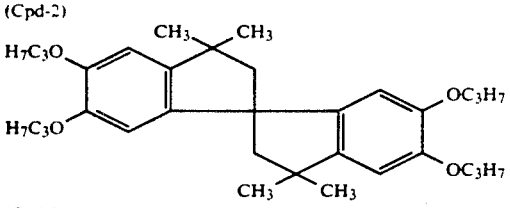

(Cpd-3)

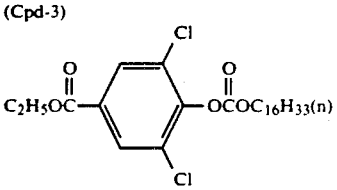

(Cpd-4)

-continued

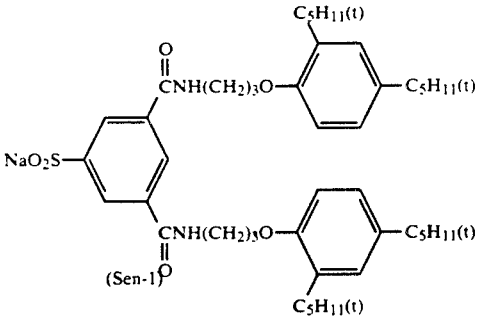

(Sen-1)

(Cpd-5)

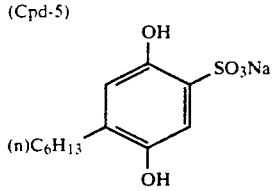

(Solv-1)

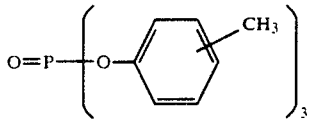

(Solv-2)

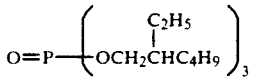

In Samples (101) to (116), gradation, pressure resistance and latent image preservation were assessed.

For exposure, a sensitometer (produced by Fuji Photo Film Co., Ltd., light source color temperature 3,200° K.) was used. The exposure was performed through an optical wedge in an amount of 250 CMS (250 lux, 1 second).

For testing pressure resistance a needle having a diameter of 1 mm was loaded with 200 g, and the exposure was performed after scratching the coated surface of the sample using the loaded needle. To test latent image preservation, one sample was processed 2 minutes after exposure and the assessment was made by comparison with a sample processed 2 hours after exposure.

After exposure, the following processing was performed.

| Process | Temperature (°C.) | Time |
|---|---|---|
| Color Development | 33 | 3 min 30 sec |
| Bleach-Fixing | 33 | 1 min 30 sec |
| Water Wash (1) | 30–34 | 60 sec |
| Water Wash (2) | 30–34 | 60 sec |
| Water Wash (3) | 30–34 | 60 sec |

-continued

| Process | Temperature (°C.) | Time |
|---|---|---|
| Drying | 70-80 | 50 sec |

(A three tank countercurrent system, (3)→(1), was used for water washing.)

The composition of each processing solution is given below.

| | |
|---|---|
| Color Developer: | |
| Water | 800 ml |
| Diethylenetriaminepentaacetic Acid | 1.0 g |
| Nitrilotriacetic Acid | 1.5 g |
| Benzyl Alcohol | 15 ml |
| Diethylene Glycol | 10 ml |
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.0 g |
| Hydroxylamine Sulfate | 4.0 g |
| Fluorescent Whitener (WHITEX 4B, produced by Sumitomo Chemical Co., Ltd.) | 1.0 g |
| Water to make | 1,000 ml |
| pH (25° C.) | 10.20 |
| Bleach-Fixing Solution: | |
| Water | 400 ml |
| Ammonium Thiosulfate (70 wt %) | 150 ml |
| Sodium Sulfite | 18 g |
| Ammonium Ethylenediaminetetraacetato-Ferrate(III) | 55 g |
| Disodium Ethylenediaminetetraacetate | 5 g |
| Water to make | 1,000 ml |
| pH (25° C.) | 6.70 |

The results are shown in Table 2.

For gradation, the difference of the logarithms of amounts of exposure made from density 0.3 to 1.8 is shown. The small difference is desirable because it results in higher contrast.

For pressure resistance, the part scratched with the needle was viewed with the naked eye. Samples with no pressure desensitization or pressure fog were rated 0. The intensity of pressure desensitization was indicated by the number of "−", and the intensity of pressure fog by the number of "+".

To test latent image preservative, taking fresh samples (after 2 minutes) as density point 1.0, the decrease in density after 2 hours was determined. The smaller the density reduction, the better the latent image preservation.

TABLE 2

| Sample | Emulsion | Gradation | Pressure Resistance | Latent Image Preservation | Note |
|---|---|---|---|---|---|
| (101) | A | 0.68 | +++ | 0.14 | Comparison |
| (102) | B | 0.49 | ++++ | 0.20 | Comparison |
| (103) | C | 0.53 | ++ | 0.11 | Comparison |
| (104) | D | 0.59 | 0 | 0.05 | Invention |
| (105) | E | 0.56 | 0 | 0.02 | Invention |
| (106) | F | 0.60 | 0 | 0.01 | Invention |
| (107) | G | 0.60 | 0 | 0.02 | Invention |
| (108) | H | 0.58 | 0 | 0.03 | Invention |
| (109) | I | 0.75 | −−− | 0.02 | Comparison |
| (110) | J | 0.82 | − | 0.12 | Comparison |
| (111) | K | 0.85 | −− | 0.09 | Comparison |
| (112) | L | 0.84 | −− | 0.10 | Comparison |
| (113) | M | 0.85 | −−− | 0.07 | Comparison |
| (114) | N | 0.62 | 0 | 0.01 | Invention |
| (115) | O | 0.72 | −− | 0.02 | Comparison |
| (116) | P | 0.57 | 0 | 0.01 | Invention |

It is clear from Table 2 that Samples (104) to (108), (114) and (116) representing the present invention were more contrasty and had photographically excellent pressure resistance and latent image preservation.

EXAMPLE 2

Temperatures and the kinds and amounts of fine grain emulsions were changed as shown below from Emulsion (F) to prepare emulsions (Q) to (U).

| | | Fine Grain Emulsion Used | | | |
|---|---|---|---|---|---|
| | | First Step | | Second Step | |
| Emulsion | Temperature (°C.) | AgCl Content (mol %) | Amount Corresponding to $AgNO_3$ (mol) | AgCl Content (mol %) | Amount Corresponding to $AgNO_3$ (mol) |
| (Q) | 76 | 12 | 0.5 | 30 | 0.5 |
| (R) | 69 | 10 | 0.5 | 30 | 0.5 |
| (S) | 58 | 10 | 0.5 | 30 | 0.5 |
| (T) | 63 | 16 | 0.5 | 36 | 0.5 |
| (U) | 57 | 16 | 0.5 | 36 | 0.5 |

Temperature and the amounts of reagents were also changed as shown below from emulsion (I) to prepare Emulsions (V) to (Z).

| Emulsion | Temperature (°C.) | First Step | | Second Step |
|---|---|---|---|---|
| (V) | 72 | $AgNO_3$ | 0.5 mol | 0.5 mol |
| | | KBr | 0.44 mol | 0.35 mol |
| | | NaCl | 0.06 mol | 0.15 mol |
| (W) | 62 | $AgNO_3$ | 0.5 mol | 0.5 mol |
| | | KBr | 0.45 mol | 0.35 mol |
| | | NaCl | 0.05 mol | 0.15 mol |
| (X) | 52 | $AgNO_3$ | 0.5 mol | 0.5 mol |
| | | KBr | 0.45 mol | 0.35 mol |
| | | NaCl | 0.05 mol | 0.15 mol |
| (Y) | 57 | $AgNO_3$ | 0.5 mol | 0.5 mol |
| | | KBr | 0.42 mol | 0.32 mol |
| | | NaCl | 0.08 mol | 0.18 mol |
| (Z) | 50 | $AgNO_3$ | 0.5 mol | 0.5 mol |
| | | KBr | 0.42 mol | 0.32 mol |
| | | NaCl | 0.08 mol | 0.18 mol |

The type, average grain size, silver halide composition and coefficient of variation are shown below for Emulsions (F), (K), (Q) to (Z).

| Emulsion | Type | Average Grain Size (μm) | Silver Halide (Br mol %) | Coefficient of Variation |
|---|---|---|---|---|
| (Q), (V) | Cubic | 0.88 | 79 | 0.06 |
| (R), (W) | Cubic | 0.65 | 80 | 0.06 |
| (F), (K) | Cubic | 0.46 | 80 | 0.09 |
| (S), (X) | Cubic | 0.35 | 80 | 0.09 |
| (T), (Y) | Cubic | 0.48 | 74 | 0.10 |
| (U), (Z) | Cubic | 0.34 | 74 | 0.10 |

In Emulsions (Q), (V), (R) and (W), the amount of the spectral sensitizer (Sen-2) which was added was $3.8 \times 10^{-4}$ mol per mol of silver halide. To Emulsions (F), (K), (S) and (X), the sensitizers (Sen-3), (Sen-4) shown below were added in amounts of $2.1 \times 10^{-4}$ mol and $4.2 \times 10^{-4}$ mol per mol of silver halide, respectively. To Emulsions (T), (Y), (U) and (Z), the spectral sensitizer (Sen-5) shown below was added in an amount of $1.8 \times 10^{-4}$ mol per mol of silver halide.

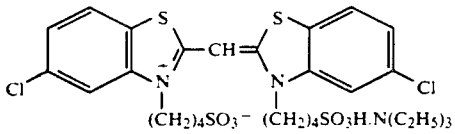

(Sen-2)

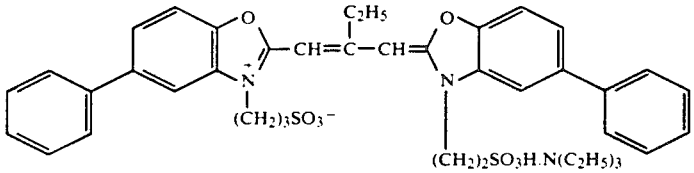

(Sen-3)

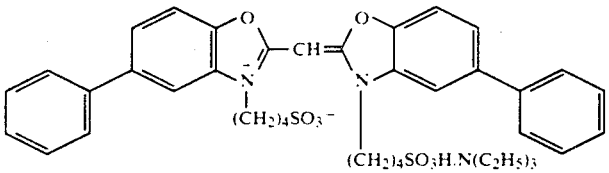

(Sen-4)

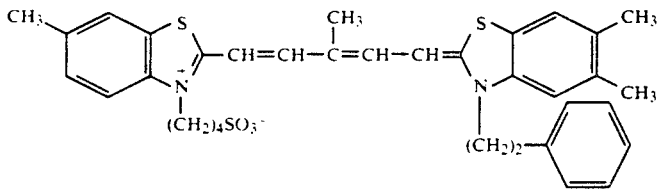

(Sen-5)

A multilayer color printing sample (201) having the layer construction as shown below on a paper support laminated on both sides with polyethylene was prepared.

Layer Construction

The ingredients used and their coverages expressed in terms of $g/m^2$ are shown below, except that for the silver halide emulsions they are expressed on a silver basis.

Support

A polyethylene Laminated Paper (containing a white pigment ($TiO_2$) and a bluish dye (ultramarine) on the fist layer side)

| | |
|---|---|
| First Layer: Blue-Sensitive Silver Halide Emulsion Layer | |
| Emulsion (Q) | 0.09 |
| Emulsion (R) | 0.21 |
| Antifoggant (Cpd-6) | 0.006 |
| Gelatin | 1.28 |
| Yellow Coupler (Example Y-1) | 0.68 |
| Solvent (Solv-3 and Solv-4 in volume ratio of 1/1) | 0.24 |
| Color Image Stabilizer (Cpd-7) | 0.07 |
| Second Layer: Color Mixing Preventing Layer | |
| Gelatin | 1.34 |
| Color Mixing Preventer (Cpd-8) | 0.04 |
| Solvent (Solv-1 and Solv-5 in volume ratio of 1/1) | 0.20 |
| Hardener (Hd) | 0.05 |
| Third Layer: | |

-continued

| | |
|---|---|
| Green-Sensitive Silver Halide Emulsion Layer | |
| Emulsion (F) | 0.075 |
| Emulsion (S) | 0.050 |
| Antifoggant (Cpd-1) | 0.001 |
| Gelatin | 1.47 |
| Magenta Coupler (Example M-10) | 0.32 |
| Color Image Stabilizer (Cpd-2) | 0.10 |
| Color Image Stabilizer (Cpd-3) | 0.08 |
| Color Image Stabilizer (Cpd-4) | 0.03 |
| Color Image Stabilizer (Cpd-5) | 0.004 |
| Solvent (Solv-1 and Solv-2 in volume ratio of 1/2) | 0.65 |
| Fourth Layer: Ultraviolet Absorbing Layer | |
| Gelatin | 1.43 |
| Ultraviolet Absorber (UV-1//2/3, mol ratio 1/4/4) | 0.47 |
| Color Mixing Preventer (Cpd-8) | 0.05 |
| Solvent (Solv-6) | 0.24 |
| Dye (Dy-1) | 0.005 |
| Dye (Dy-2) | 0.015 |
| Hardener (Hd) | 0.05 |
| Fifth Layer: Red-Sensitive Silver Halide Emulsion Layer | |
| Emulsion (T) | 0.06 |
| Emulsion (U) | 0.14 |
| Antifoggant (Cpd-6) | 0.008 |
| Antifoggant (Cpd-9) | 0.0001 |
| Antifoggant (Cpd-10) | 0.0001 |
| Gelatin | 0.85 |
| Cyan Coupler (Example C-4) | 0.13 |
| Cyan Coupler (Example C-3) | 0.15 |
| Ultraviolet Absorber (UV-1/3/4, mol ratio 1/3/3) | 0.07 |
| Color Image Stabilizer (Cpd-7) | 0.28 |
| Color Image Stabilizer (Cpd-3) | 0.004 |
| Color Image Stabilizer (Cpd-4) | 0.007 |
| Solvent (Solv-3) | 0.16 |
| Sixth Layer: Ultraviolet Absorbing Layer | |
| Gelatin | 0.38 |
| Ultraviolet Absorber (UV-1/2/3, mol ratio 1/4/4) | 0.13 |
| Solvent (Solv-6) | 0.06 |
| Hardener (Hd) | 0.05 |

-continued

| Seventh Layer: Protective Layer | |
|---|---|
| Gelatin | 1.25 |
| Acryl Modified Copolymer of Polyvinyl Alcohol (modification degree 17%) | 0.05 |
| Liquid Paraffin | 0.02 |

(Cpd-6)

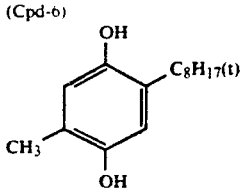

(Cpd-7)

$\leftarrow CH_2-CH\rightarrow_n$
$\quad\quad |$
$\quad\quad CONHC_4H_9(n)$

Average molecular weight: 60,000

(Cpd-8)

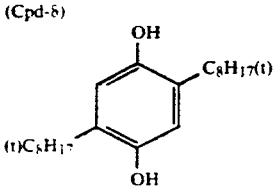

(Cpd-9)

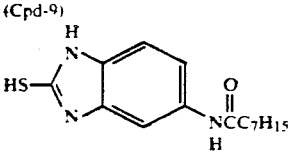

(Cpd-10)

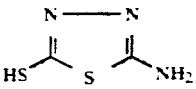

(UV-1)

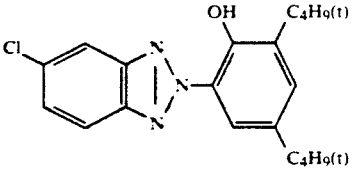

(UV-2)

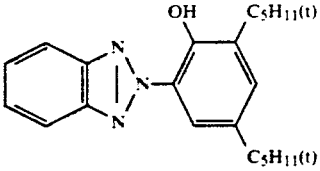

(UV-3)

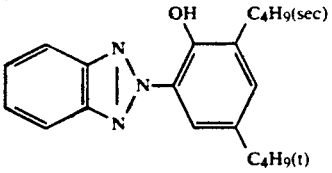

(UV-4)

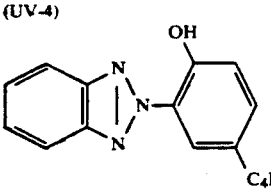

(Solv-3)

$C_8H_{17}-\underset{O}{\underset{\diagdown\ \diagup}{CH-CH}}\leftarrow CH_2\rightarrow_7 COOC_8H_{17}$ -continued (Solv-4)

$O=P\leftarrow O-C_9H_{19}\text{-iso})_3$ (Solv-5)

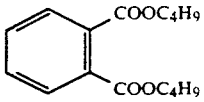

(Solv-6)

$COOCH_2CHC_4H_9$
$\quad |\quad\quad\quad |$
$(CH_2)_8\quad C_2H_5$
$\quad |$
$COOCH_2CHC_4H_9$
$\quad\quad\quad |$
$\quad\quad C_2H_5$ (Hd)

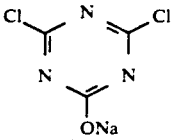

(Dy-1)

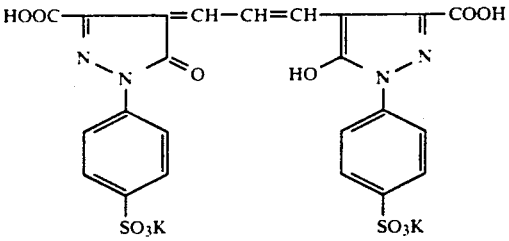

(Dy-2)

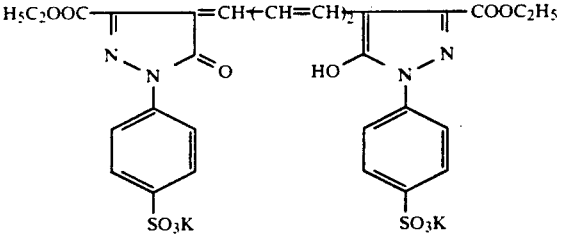

Further more, by exchanging Emulsions (Q) with (V), (R) with (W), (F) with (K), (S) with (X), (T) with (Y), and (U) with (Z), Sample (202) was prepared.

Using the same assessment methods used in Example 1, the following processing was performed after exposure was performed.

| Process | Temperature (°C.) | Time |
|---|---|---|
| Color Development | 38 | 1 min 40 sec |
| Bleach-Fixing | 35 | 60 sec |
| Rinse (1) | 33-35 | 20 sec |
| Rinse (2) | 33-35 | 20 sec |
| Rinse (3) | 33-35 | 20 sec |
| Drying | 70-80 | 50 sec |

The composition of each processing solution was as follows.

| Color Developer: | |
|---|---|
| Water | 800 ml |
| Diethylenetriaminepentaacetic Acid | 1.0 g |
| Nitrilotriacetic Acid | 2.0 g |
| 1-Hydroxyethylidene-1,1-diphosphonic Acid | 2.0 g |
| Benzyl Alcohol | 16 ml |
| Diethylene Glycol | 10 ml |

-continued

| | |
|---|---|
| Sodium Sulfite | 2.0 g |
| Potassium Bromide | 0.5 g |
| Potassium Carbonate | 30 g |
| N-Ethyl-N-(β-methanesulfonamidoethyl)-3-methyl-4-aminoaniline Sulfate | 5.5 g |
| Hydroxylamine Sulfate | 2.0 g |
| Fluorescent Brightener (WHITEX 4B, produced by Sumitomo Chemical Co., Ltd.) | 1.5 g |
| Water to make | 1,000 ml |
| pH (25° C.) | 10.20 |
| Bleach-Fixing Solution: | |
| Water | 400 ml |
| Ammonium Thiosulfate (70 wt %) | 80 ml |
| Sodium Sulfite | 24 g |
| Ammonium Ethylenediaminetetraacetato-Ferrate(III) | 30 g |
| Disodium Ethylenediaminetetraacetate | 5 g |
| Water to make | 1,000 ml |
| pH (25° C.) | 6.5 |

Rinse Solution

Ion exchanged water (calcium, magnesium respective 3 ppm or less)

The results are shown in Table 3. It is clear from Table 3 that Sample (201) of the present invention, relative to Comparative Sample (202), showed excellent photographic properties in terms of pressure resistance and latent image preservation.

| Sample | | Pressure Resistance | Latent Image Preservation | Note |
|---|---|---|---|---|
| | B | 0 | 0.01 | |
| (201) | G | 0 | 0.01 | Invention |
| | R | 0 | 0.01 | |
| | B | – – – | 0.13 | |
| (202) | G | – – | 0.08 | Comparison |
| | R | – – | 0.10 | |

(B Blue-sensitive layer, G Green-sensitive layer, R Red-sensitive layer)

As demonstrated above, therefore, the present invention can provide a silver halide photographic material with excellent gradation, pressure resistance and latent image preservation. Even under conditions of hard treatment and processing, good photographic properties can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising at least one silver halide emulsion layer on a support, said silver halide emulsion containing silver chlorobromide grains having a 2 to 4 layer stacked structure which layers differ in their content of silver chloride, wherein the silver chloride distribution of each layer of said grains is completely uniform, and wherein the difference in the silver chloride content between a first layer and a second layer of said grains ranges from 5 mol% to 27 mol%.

2. A silver halide color photographic material according to claim 1, wherein said silver chlorobromide grains have a 2 or 3 layer stacked structure.

3. A silver halide color photographic material according to claim 1, wherein the difference in silver chloride content between a first layer and a second layer of said grains ranges from 10 mol% to 23 mol%.

4. A silver halide color photographic material according to claim 1, wherein the difference in silver chloride content between a first layer and a second layer of said grains ranges from 8 mol% to 25 mol%.

5. A silver halide color photographic material according to claim 1, wherein said silver chlorobromide grains comprise 10 mol% to 95 mol% silver chloride.

6. A silver halide color photographic material according to claim 5, wherein said grains comprise at least 20 mol% silver chloride.

7. A silver halide color photographic material according to claim 6, wherein the overall composition of the stacked silver halide grains further comprises silver iodide in an amount less than 1 mol %.

8. A silver halide color photographic material according to claim 6, wherein said grains contain no silver iodide.

9. A silver halide color photographic material according to claim 1, wherein said stacked silver halide grains have not more than 2 lines displaying microscopic silver chloride distribution in a 0.2 μm interval in the direction crossing grain growth, in the transmission images of the grains obtained using a cooled transmission electron microscope.

10. A silver halide color photographic material according to claim 1, wherein said stacked silver halide grains have 1 line displaying microscopic silver chloride distribution in a 0.2 μm interval in the direction crossing grain growth, in the transmission images of the grains obtained using a cooled transmission electron microscope.

11. A silver halide color photographic material according to claim 1, wherein said stacked silver halide grains have no lines displaying microscopic silver distribution in a 0.2 μm interval in the direction crossing grain growth, in the transmission images of the grains obtained using a cooled transmission electron microscope.

12. A silver halide color photographic material according to claim 1, wherein said emulsion layer contains silver halide grains, at least 40% of which are said silver chlorobromide grains having a stacked structure and uniform silver chloride distribution.

13. A silver halide color photographic material according to claim 1, wherein said emulsion layer contains silver halide grains, at least 60% of which are said silver chlorobromide grains having a stacked structure and uniform silver chloride distribution.

14. A silver halide color photographic material according to claim 1, wherein said emulsion layer contains silver halide grains, at least 80% of which are said silver chlorobromide grains having a stacked structure and uniform silver chloride distribution.

15. A silver halide color photographic material according to claim 1, wherein said support is a light reflective support.

* * * * *